US010716414B2

(12) United States Patent
Kacius et al.

(10) Patent No.: US 10,716,414 B2
(45) Date of Patent: Jul. 21, 2020

(54) ROTATABLE PICTURE FRAME

(71) Applicant: DYNAMIC FRAMES, INC., Torrance, CA (US)

(72) Inventors: Timothy A. Kacius, Torrance, CA (US); Zhiqiang Jiang, Dongguan (CN)

(73) Assignee: DYNAMIC FRAMES, INC., Torrance, CA (US)

( * ) Notice: Subject to any disclaimer, the term of this patent is extended or adjusted under 35 U.S.C. 154(b) by 0 days.

(21) Appl. No.: 16/414,917

(22) Filed: May 17, 2019

(65) Prior Publication Data

US 2019/0269262 A1 Sep. 5, 2019

Related U.S. Application Data

(63) Continuation-in-part of application No. 15/959,977, filed on Apr. 23, 2018, now abandoned, which is a continuation of application No. 15/373,855, filed on Dec. 9, 2016, now Pat. No. 9,949,581.

(60) Provisional application No. 62/266,434, filed on Dec. 11, 2015.

(51) Int. Cl.

| | |
|---|---|
| ***A47G 1/06*** | (2006.01) |
| ***A47G 1/14*** | (2006.01) |
| ***A47G 1/16*** | (2006.01) |
| ***A47G 1/24*** | (2006.01) |

(52) U.S. Cl.

CPC ..... *A47G 1/06* (2013.01); *A47G 1/065* (2013.01); *A47G 1/142* (2013.01); *A47G 1/1606* (2013.01); *A47G 1/1613* (2013.01); *A47G 1/24* (2013.01); *A47G 2001/0666* (2013.01); *A47G 2001/0677* (2013.01); *A47G 2001/0694* (2013.01)

(58) Field of Classification Search

CPC ..... A47G 1/06; A47G 1/1613; A47G 1/24; A47G 1/1606; A47G 1/065; A47G 1/142; A47G 2001/0666; A47G 2001/0677; A47G 2001/0694

USPC ..... 248/475.1, 479, 470, 466, 489, 224.8, 248/495

See application file for complete search history.

(56) References Cited

U.S. PATENT DOCUMENTS

| | | | | |
|---|---|---|---|---|
| 73,808 A | | 1/1868 | Hodges | |
| 994,448 A | * | 6/1911 | Ferris | 16/94 R |
| 1,345,170 A | * | 6/1920 | Gross | A47H 1/022 211/105.2 |
| 1,513,027 A | | 10/1924 | Belli | |
| 1,754,851 A | | 4/1930 | Dey | |
| 2,463,110 A | | 3/1949 | Johnson | |
| 2,681,194 A | * | 6/1954 | Halvorsen | A47G 1/1626 248/495 |

(Continued)

FOREIGN PATENT DOCUMENTS

DE 20-2013104478 U1 2/2015

*Primary Examiner* — Cassandra Davis

(74) *Attorney, Agent, or Firm* — Barnes & Thornburg LLP

(57) ABSTRACT

The present disclosure relates generally to picture frames and picture cabinets, and more specifically to rotatable picture frames and picture cabinets. In some embodiments, the picture frame may be easily rotatable between a landscape display and a portrait display via a set of recesses that correspond to a set of protrusions on a hanging mount. The picture frame may also support a varying number of photographs in a varying number of picture support compartments while also allowing the picture frame to be accessible while said picture frame is mounted on a planar surface such as a wall.

14 Claims, 20 Drawing Sheets

(56) References Cited

U.S. PATENT DOCUMENTS

| | | | | | |
|---|---|---|---|---|---|
| 2,740,603 | A | | 4/1956 | Wofford | |
| 2,757,890 | A | | 8/1956 | Sutton | |
| 2,761,640 | A | | 9/1956 | Frater | |
| 3,672,622 | A | * | 6/1972 | Breslow | F16B 12/56 248/223.41 |
| 3,946,512 | A | | 3/1976 | Shapiro | |
| 3,981,091 | A | | 9/1976 | Wiener, Jr. | |
| 4,216,936 | A | | 8/1980 | DeSelms | |
| 4,441,268 | A | | 4/1984 | Scott | |
| 4,458,873 | A | | 7/1984 | Sutherland | |
| 4,561,617 | A | | 12/1985 | Hafner | |
| 4,641,441 | A | | 2/1987 | Roth | |
| 4,979,323 | A | | 12/1990 | Wenkman | |
| 5,042,766 | A | * | 8/1991 | Baker | F16M 13/025 248/200.1 |
| 5,075,991 | A | | 12/1991 | Wenkman | |
| 5,425,525 | A | | 6/1995 | Cevasco | |
| 5,480,120 | A | | 1/1996 | Bruner | |
| 5,836,565 | A | | 11/1998 | Chang | |
| 6,142,320 | A | * | 11/2000 | DeLorean | A47B 81/005 211/105.1 |
| 6,282,827 | B1 | | 9/2001 | Holmes | |
| 6,438,883 | B1 | | 8/2002 | Kacius | |
| 6,471,177 | B1 | * | 10/2002 | Emrick | A47H 1/14 248/544 |
| 6,645,031 | B2 | | 11/2003 | Rothkopf | |
| 6,651,943 | B2 | | 11/2003 | Cho | |
| 7,028,425 | B2 | | 4/2006 | Lasher | |
| 7,448,507 | B1 | | 11/2008 | Abernathy | |
| 7,836,623 | B2 | | 11/2010 | Wang et al. | |
| 8,458,943 | B2 | | 6/2013 | Horne | |
| 8,935,837 | B2 | | 1/2015 | Jairala, Jr. | |
| 8,939,414 | B2 | | 1/2015 | Manno | |
| 9,650,789 | B2 | | 5/2017 | Gulnick | |
| 2005/0044767 | A1 | | 3/2005 | Lasher | |
| 2005/0127263 | A1 | | 6/2005 | Lemire | |
| 2007/0062088 | A1 | | 3/2007 | Vanderberg | |
| 2008/0237434 | A1 | | 10/2008 | Lin | |
| 2009/0139127 | A1 | | 6/2009 | Southard | |
| 2010/0000133 | A1 | | 1/2010 | Kent | |
| 2010/0192437 | A1 | | 8/2010 | Fallander | |
| 2012/0260549 | A1 | | 10/2012 | Andrulewich | |
| 2015/0272350 | A1 | | 10/2015 | Frankenstein | |
| 2017/0164764 | A1 | | 6/2017 | Kacius | |

* cited by examiner

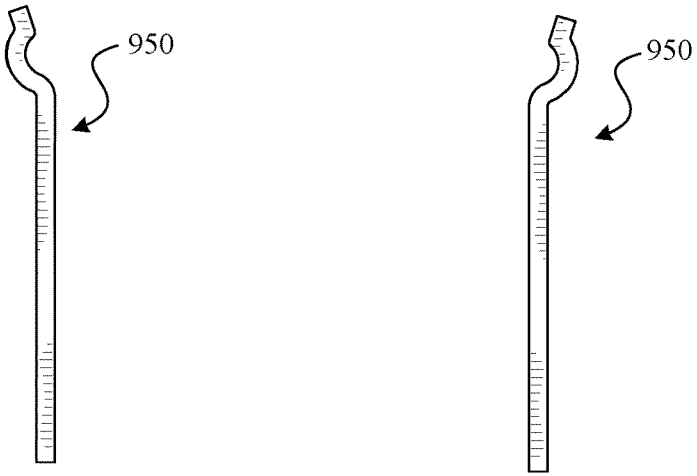
FIG. 13
FIG. 14
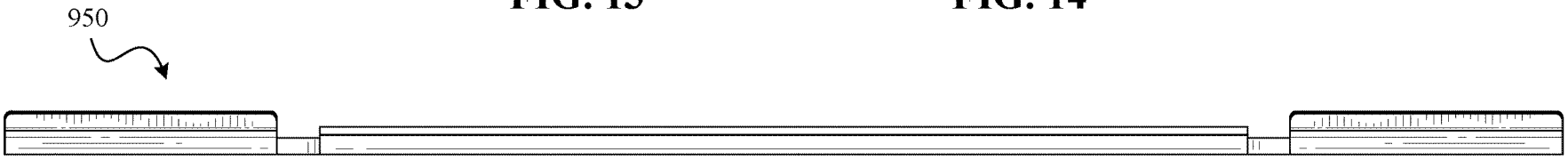
FIG. 15
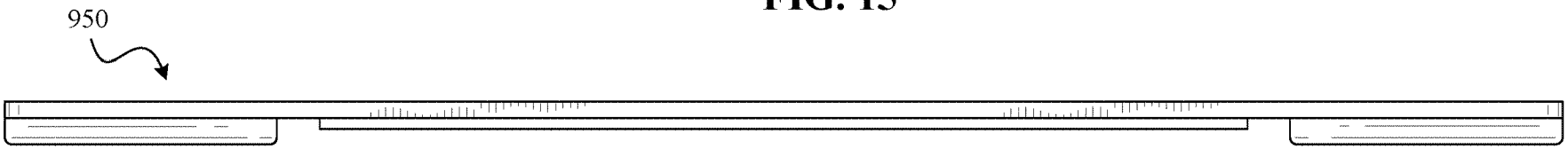
FIG. 16

ROTATABLE PICTURE FRAME

CROSS REFERENCE TO RELATED APPLICATIONS

The application is a Continuation-in-Part of U.S. patent application Ser. No. 15/959,977, filed Apr. 23, 2018, which is a Continuation of U.S. patent application Ser. No. 15/373,855, filed Dec. 9, 2016 (now U.S. Pat. No. 9,949,581), which claims the benefit of priority under 35 U.S.C. § 119(e) to U.S. Provisional Patent Application No. 62/266,434, filed Dec. 11, 2015. The disclosures set forth in the referenced applications are incorporated herein by reference in their entirety.

FIELD OF THE DISCLOSURE

The present disclosure relates generally to picture frames and picture cabinets, and more specifically to rotatable picture frames and picture cabinets, which may be capable of holding more than one picture, postcard, drawing, greeting card, document, or object of a size which allows it to fit within the picture cabinet and which users would like to display (herein generally referred to as "pictures") in a single frame. The picture frame may support a varying number of photographs (or pictures) in a varying number of picture support compartments while also allowing the picture frame to be accessible while said picture frame is mounted on a planar surface such as a wall.

BACKGROUND

It is known in the art to provide picture frames capable of displaying multiple pictures. For example, picture frames including several display areas within a single set of frame borders and picture frames providing multiple and corresponding picture support compartments are known in the art. It is known in the art to provide removable mat boards with pictures frames. It is also known in the art to manufacture picture frames with removable picture support compartments and matching, removable mat boards. It is not known, however, to manufacture pictures frames that can easily switch orientations. It is also not known to manufacture pictures frames that can easily switch orientations and remain fastened to the wall when a change to the balance point is created, e.g., when a front door is opened.

SUMMARY

The present disclosure may comprise one or more of the following features and combinations thereof.

A system according to some embodiments may include a hanging mount with attachment means for securing the hanging mount to a surface. The hanging mount may include a plurality of protrusions. The system may include a picture frame with a first set of recesses corresponding to the plurality of protrusions for releasably attaching the hanging mount to the picture frame in a first orientation. The picture frame may include a second set of recesses corresponding to the plurality of protrusions for releasably attaching the hanging mount to the picture frame in a second orientation.

According to some embodiments of the present disclosure, a system may include a hanging mount with attachment means for securing the hanging mount to a surface. The hanging mount may include a plurality of protrusions. The system may include a picture frame with a first set of recesses corresponding to the plurality of protrusions for releasably attaching the hanging mount to the picture frame in a first orientation. The picture frame may include a second set of recesses corresponding to the plurality of protrusions for releasably attaching the hanging mount to the picture frame in a second orientation. The picture frame may include a third set of recesses corresponding to the plurality of protrusions for releasably attaching the hanging mount to the picture frame in the first orientation. The third set of recesses may be configured such that the picture frame can be mounted at two different heights or widths in the first orientation. The picture frame may include a fourth set of recesses corresponding to the plurality of protrusions for releasably attaching the hanging mount to the picture frame in the second orientation. The fourth set of recesses may be configured such that the picture frame can be mounted at two different heights or widths in the second orientation.

According to some embodiments of the present disclosure, a picture frame may include a first set of recesses corresponding to a plurality of protrusions for releasably attaching the hanging mount to the picture frame in a first orientation. The picture frame may include a second set of recesses corresponding to the plurality of protrusions for releasably attaching the hanging mount to the picture frame in a second orientation.

These and other features of the present disclosure will become more apparent from the following description of the illustrative embodiments.

BRIEF DESCRIPTION OF THE DRAWINGS

FIG. 13 is a right side view of a hanging mount, according to some embodiments of the invention;

FIG. 14 is a left side view of a hanging mount, according to some embodiments of the invention;

FIG. 15 is a top view of a hanging mount, according to some embodiments of the invention;

FIG. 16 is a bottom view of a hanging mount, according to some embodiments of the invention;

DETAILED DESCRIPTION OF THE DRAWINGS

Figure 1:
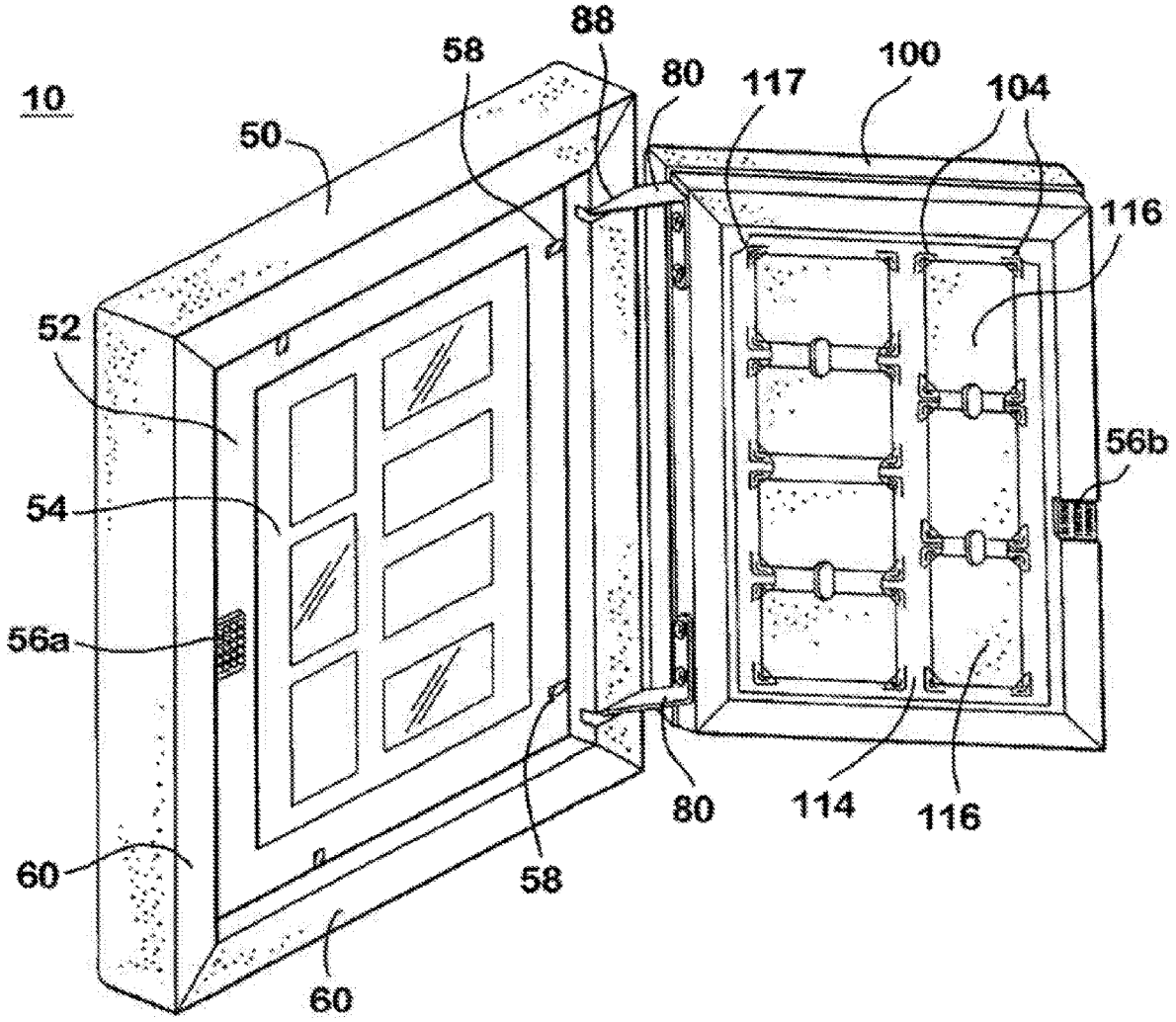
FIG. 1 is a perspective view of a picture frame in an open position, according to some embodiments of the invention.

For the purposes of promoting an understanding of the principles of the disclosure, reference will now be made to a number of illustrative embodiments illustrated in the drawings and specific language will be used to describe the same.

While this invention is susceptible of embodiments in many different forms, there is herein described in detail, embodiments of the invention with the understanding that the present disclosure is to be considered as an exemplification of the principles of the invention and is not intended to limit the broad aspects of the invention to the embodiments illustrated herein.

In some embodiments of the invention and as exemplified in FIG. 1, a picture frame or picture cabinet 10 with multiple picture compartments 116, capable of storing more than one picture, post-card, drawing, greeting card, document or object of a size which allows it to fit within the picture cabinet and which users would like to display (herein generally referred to as "pictures") in each compartment 116, is provided. The picture frame 10 is comprised of a front frame member 50 hingeably and removably attached to a rear support member 100. The front frame member 50 is comprised of frame borders 60 which surround a transparent display window 54, which could be constructed of glass, plastic or other transparent materials of a similar nature. The front frame member 50 also includes a removable mat board 52 mounted on the inside of the transparent display window 54. The matboard 52 forms a border on the inside of the display window 54 and is releasably secured to the display window 54 by flexible support arms 58 attached to the frame borders 60. The front frame member 50 is releasably connected to the rear support member 100 and connected on one side by two hinges 80, however, embodiments of the picture frame could be altered to include only one hinge 80 or more than two hinges 80.

Figure 4:
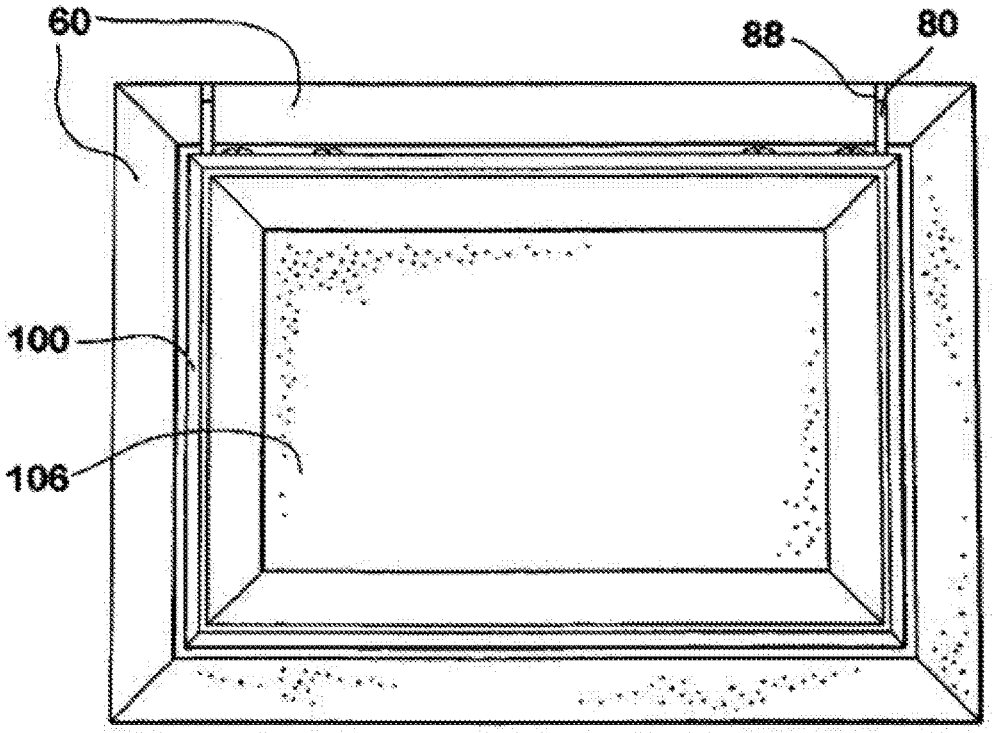
FIG. 4 is a rear elevational view of a picture frame, according to some embodiments of the invention.
Figure 5:
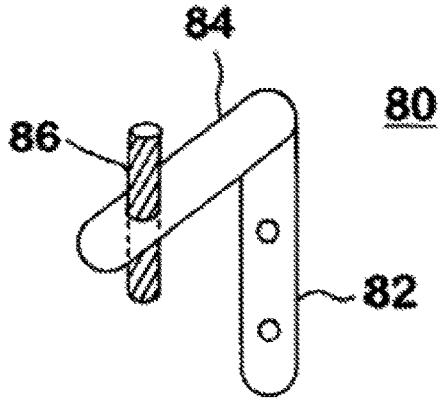
FIG. 5 is an enlarged, perspective view of the hinge shown in FIG. 1.
Figure 6:
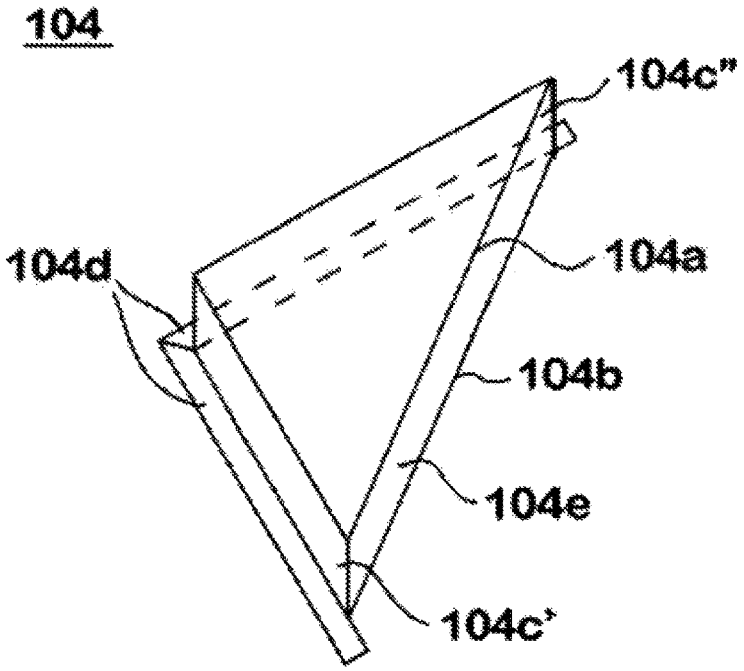
FIG. 6 is an enlarged, perspective view of the corner support shown in FIG. 1.
Figure 7:
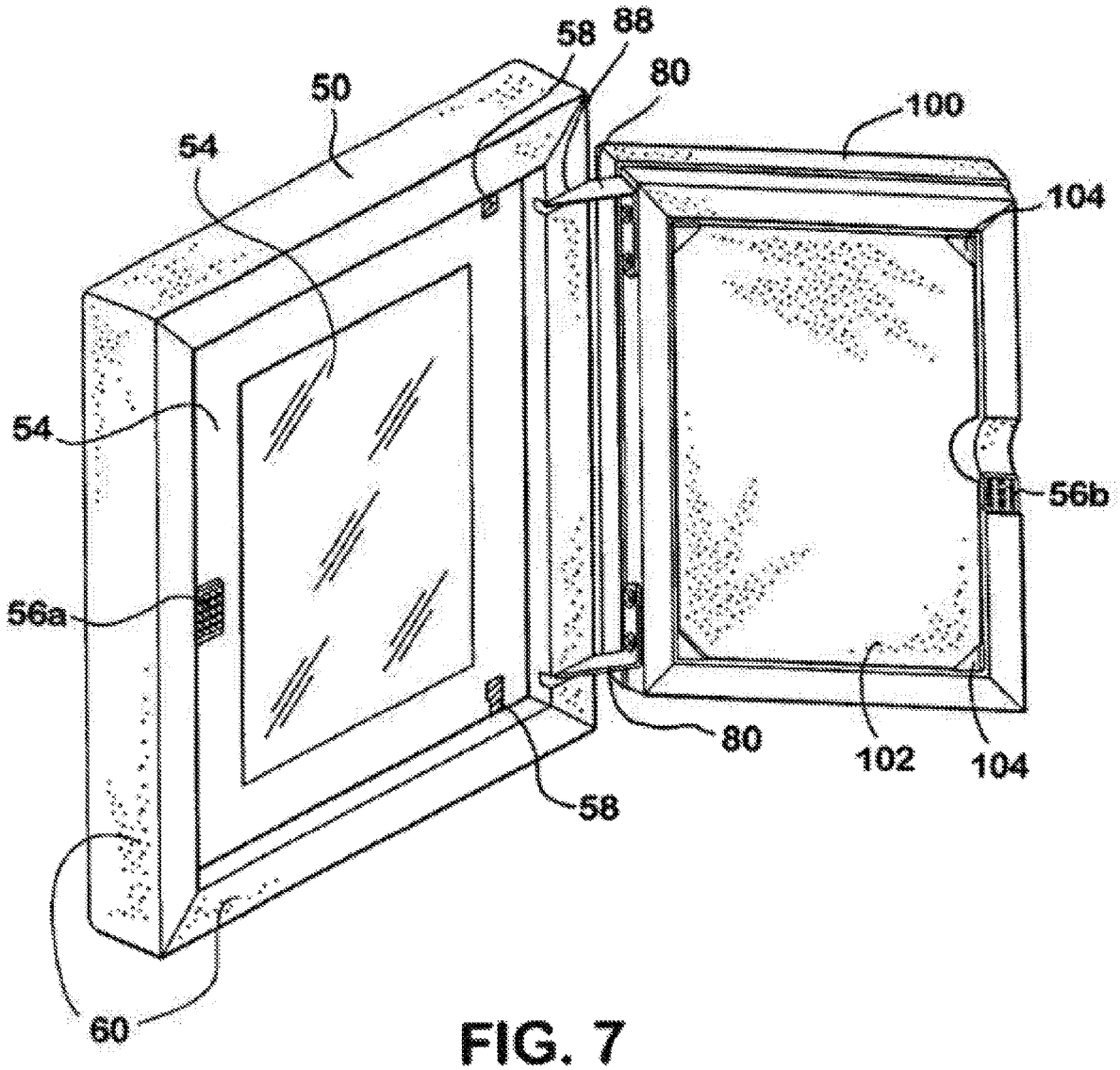
FIG. 7 is a perspective view of a picture frame in an open position, according to some embodiments of the invention.

As shown in FIG. 5, the hinge 80 is comprised of an L-shaped member having a first leg 82 and a second leg 84. The first leg 82 is attached to the rear support member 100 and the second leg is rotatably attached to a support pin 58 which is attached to the front frame member 50. Further, as shown in FIG. 4, the front frame member 50 includes a hinge slit 88 that runs perpendicular to the frame border 60 on which the hinge slit 88 is located. The support pin 86 is located within and perpendicular to the hinge slit 88. The second leg 84 fits within the hinge slit 88 and is rotatably connected to the support pin 86, thereby allowing the front frame member 50 to rotate in the same plane as the rear 20 support member 100. This allows the picture frame 10 to be opened up to 180 degrees without removing the picture frame from the wall or other plane or surface on which it is mounted.

Figure 2:
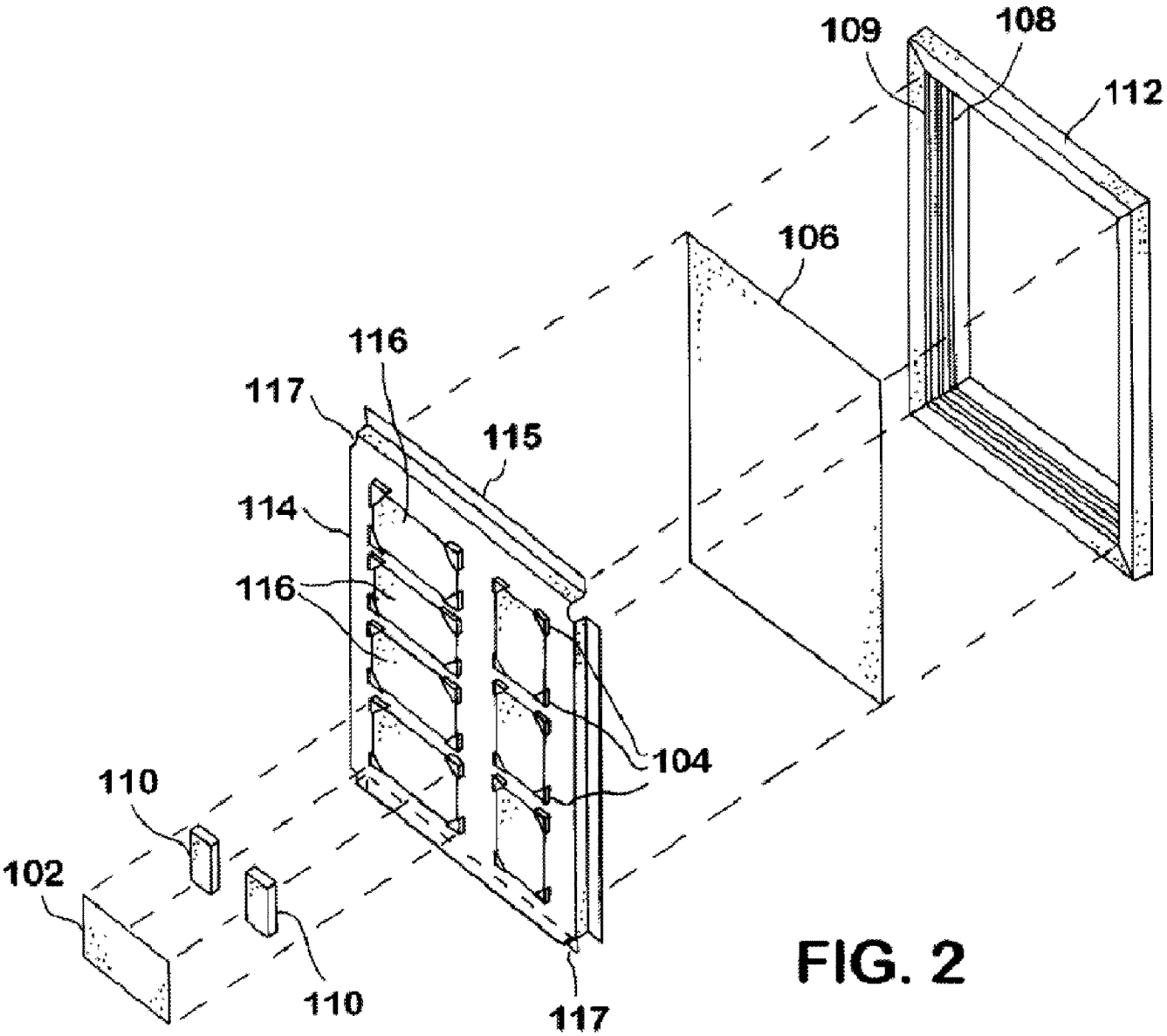
FIG. 2 is an exploded view of a rear support member, according to some embodiments of the invention.
Figure 3:
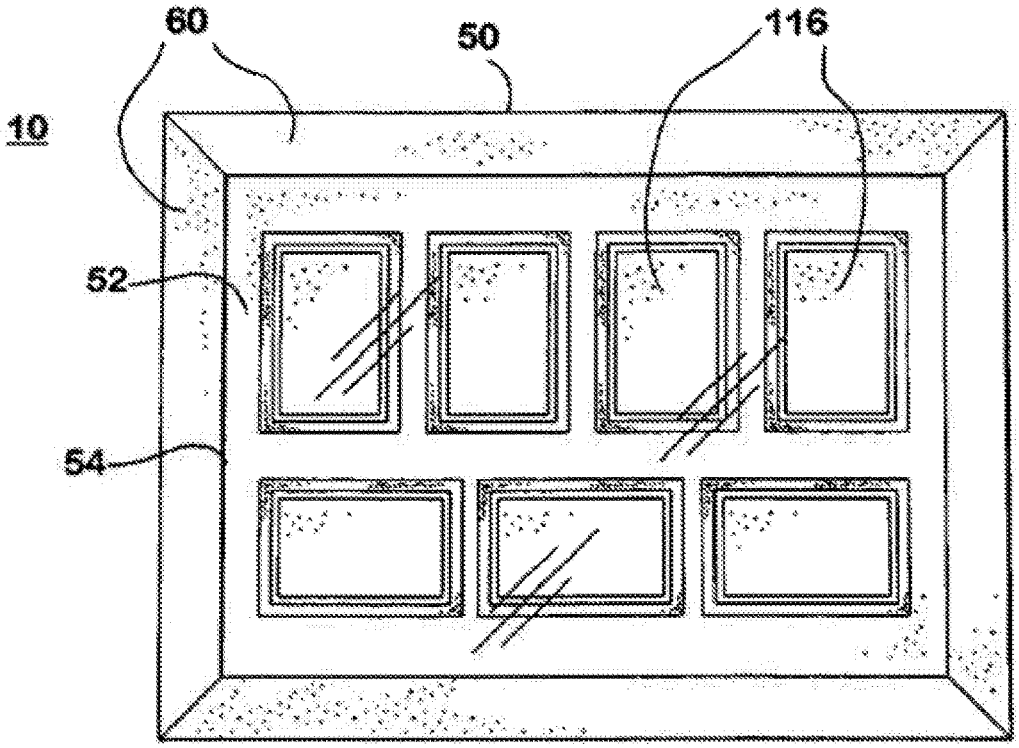
FIG. 3 is a front elevational view of a picture frame, according to some embodiments of the invention.

As shown in FIG. 1, the rear support member 100 is hingeably connected to the front frame member 50. Further, as shown in FIG. 2, the rear support member 100 is comprised of a rear frame member 112 with a groove 108 provided on the inside portion of the rear frame member 112. A rear panel 106 is mounted within the groove 108 of the rear frame member 112. Also, a channel 109 is provided on the inside portion of the rear frame member 112 between the groove 108 and the front frame member 50. A picture compartment support 114 is mounted within the channel 109 of the rear frame member 112 where the edge 115 of the picture compartment support 114 is positioned within the channel 109. In the preferred embodiment and as shown in FIG. 1, the picture compartment support 114 includes at least one picture compartment 116 and each of the picture compartments 116 includes integral corner supports 104. The picture compartment support 114 also includes at least one corner aperture 117 which allows the picture compartment support 114 to be removed by securing the picture compartment from within the corner aperture 117. As described below in a discussion of an alternative embodiment, the corner supports 104 can be separate from the picture compartment support 114.

Moreover, an adjustment means 110 and a rear picture support 102 are removably secured within each picture compartment 116 by the corner supports 104. The rear picture support 102 is comprised of a flexible material, such as, cardboard. Thus, the rear picture support 102 can be removed from the respective picture compartment 116 by flexing or bending the rear picture support 102 to avoid some of the corner supports 104 thereby allowing the rear picture support 102 to be removed. The adjustment means 110 is comprised of a compressible, yet resilient, material such as a sponge or spring. Thus, the adjustment means 110 places a constant, yet variable, force upon the rear picture support 102 toward the display window 54.

A releasable attachment means 56 is provided, on the opposite side of the front frame member 50 and rear frame member 112 from the hinge 80, to releasably attach the front frame member 50 to the rear support member 100. One type of attachment means includes a lever with a hook shaped portion that is securably and releasably attachable to a protrusion, such as a screw head, nail head or similar item, and the hook shaped portion of the lever partially encompasses at least a portion of the protrusion. Another type of attachment means 56 includes a first strip 56*a* and a second strip 56*b*. The first strip 56*a* is comprised of hook fasteners 5 and is attached to the mat board 52, and the second strip

56*b* is comprised of loop fasteners and is attached to the rear frame member 112. When the picture frame 10 is in a closed position, the first strip 56*a* and the second strip 56*b* interact with one another and releasably secure the front frame member 50 to the rear support member 100.

Figure 8:
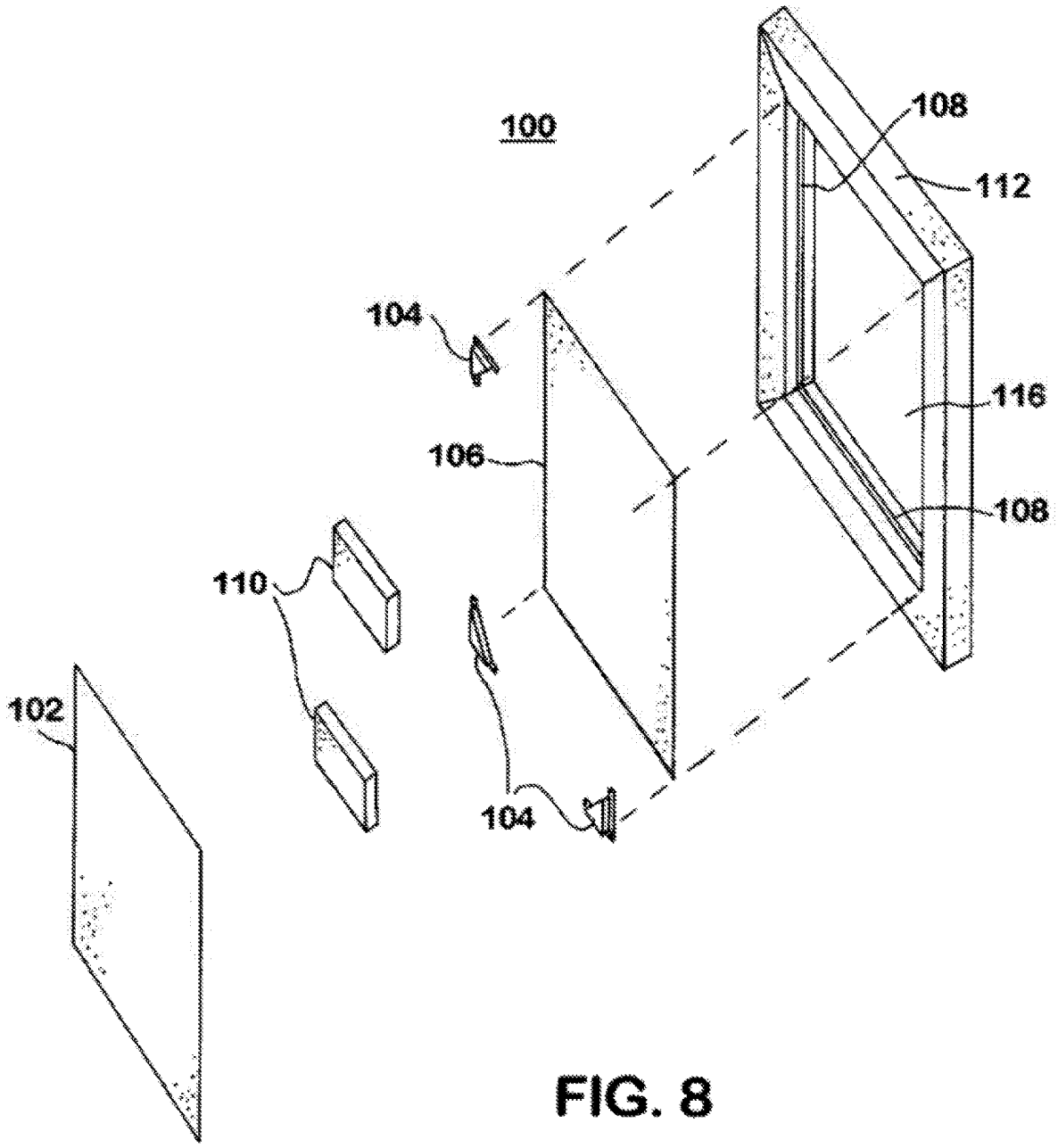
FIG. 8 is an exploded view of the rear support member shown in FIG. 7.
Figure 10:
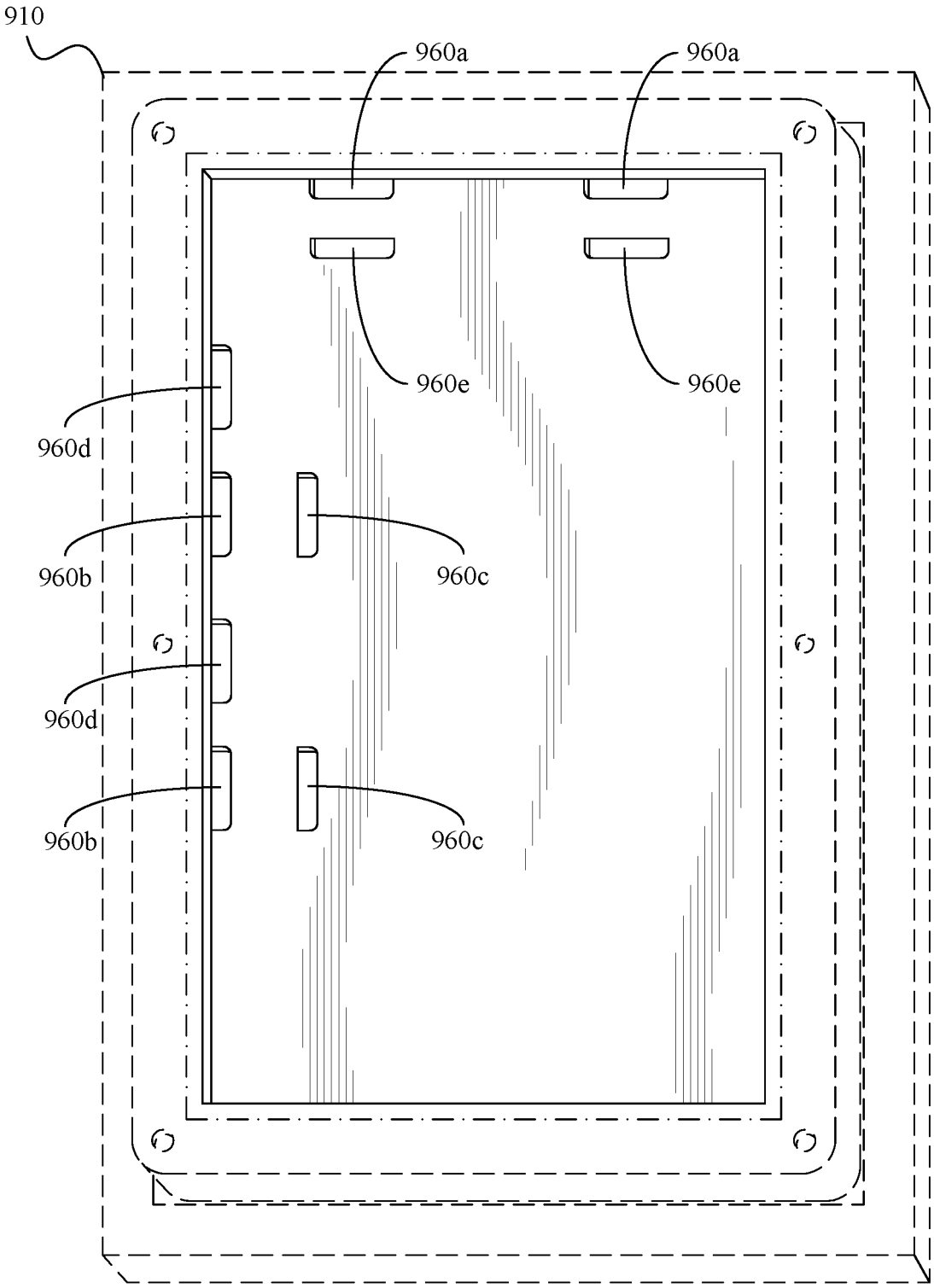
FIG. 10 is a rear view of a picture frame, according to some embodiments of the invention.

In some embodiments of the invention and as shown in FIG. 8, a picture frame 10 with a single picture compartment 116, capable of storing more than one picture in said compartment 116, is provided. The rear support member 100 is comprised of a rear frame member 112 with a groove 108 provided on the inside portion of the rear frame member 112. A rear panel 106 and corner supports 104 are capable of being mounted within the groove 108 of the rear frame member 112. Moreover, an adjustment means 110 and a rear picture support 102 are removably secured to the rear frame member 112 by the corner supports 104. Therefore, in some embodiments, the channel 109 is not present and the corner supports 104 are mounted within the groove 108 of the rear panel 106. In some embodiments and as shown in FIG. 10, the corner supports 104 are comprised of a top wall 104*a* connected to a bottom wall 104*b* by side walls 104*c*' and 104*c*", an opening 104*e* and a pair of ridges 104*d* which extend perpendicularly to side walls 104*c*' and 104*c*". The corner supports 104 are attached to the rear frame member 112 by placing the ridge 104*d* within the groove 108 of the rear frame member 112. Further, each of the corner supports 104 will be placed in one of the respective corners of the rear frame member 112 such that the side walls 104*c*' and 104*c*"will both abut the rear frame member 112 and the opening 104*e* will face the opposing corner of the rear frame member 112.

By allowing the picture compartment support 114, the rear picture support 102, and the mat board 52 to be removable, the number of compartments 116 for storing pictures can be changed by removing the picture compartment support 114, the rear picture support 102 and the mat board 52 and replacing them with an alternative picture compartment support 114, rear picture support 102, and correlating mat board 52. This allows purchasers of the picture frames 10 to vary the storage capability of the picture frame 10 without replacing the entire frame 10.

The hinge 80 as used in the picture frame 10 is designed to allow the picture frame 10 to be accessed and to be opened while the frame 10 is mounted on a planer surface such as a wall. Additionally, the hinge 80 is designed to interact with the front frame member 50 and the rear support member 100 without requiring significant retooling of the front frame member 50 or the rear support member 100.

Also, the front frame member 50 may be removably attachable to the rear support member 100. This allows the picture frame user to remove the front frame member 50 from the rear support member 100 and replace it with a front frame member 50 comprised of a different material, i.e., a user may replace a wood front frame member with a plastic front frame member. Thus, the picture frame user can change the look and feel of the picture frame 10 without purchasing an entirely new picture frame 10.

Figure 9:
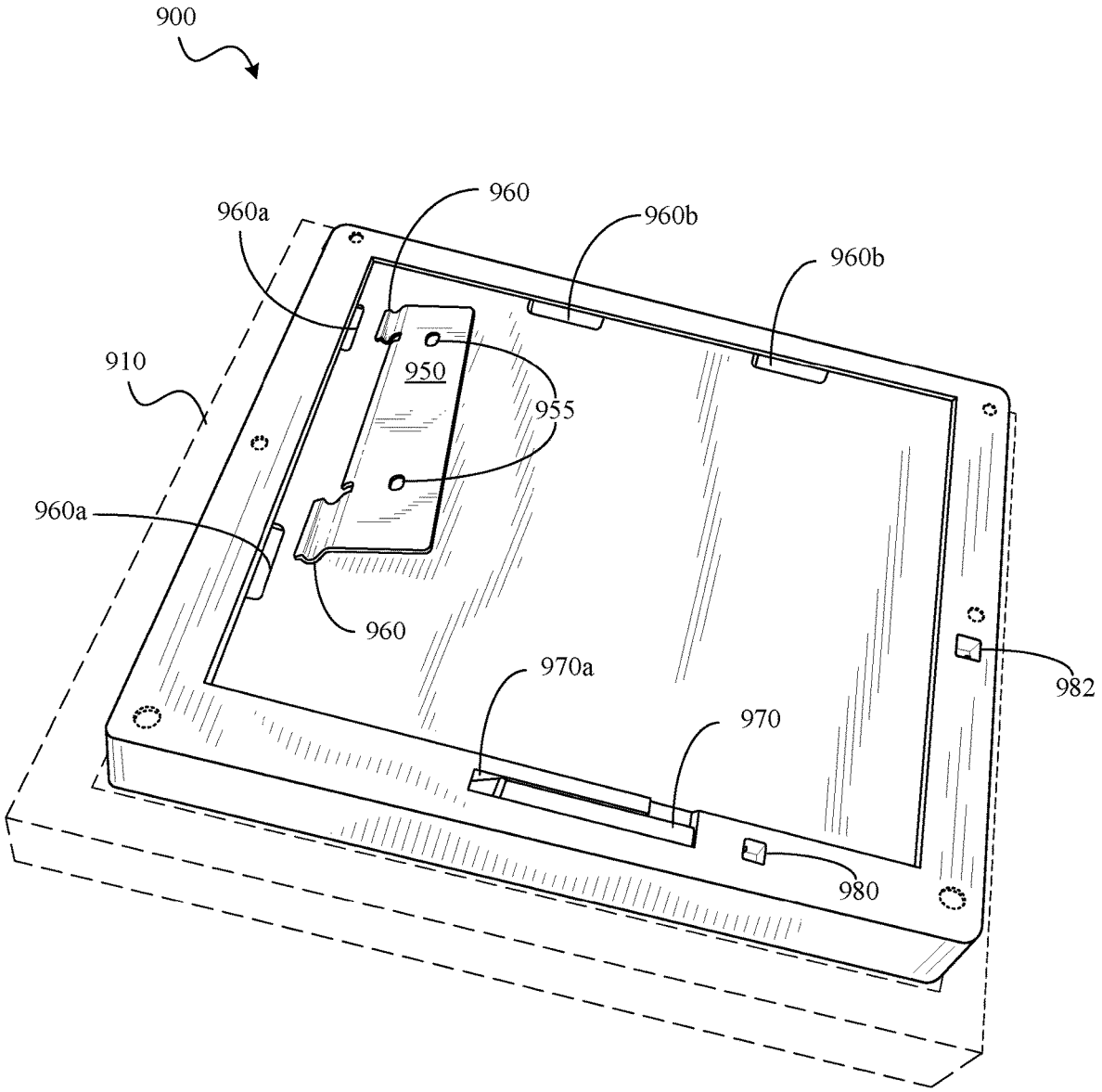
FIG. 9 is a perspective view of a picture frame and hanging mount, according to some embodiments of the invention.

FIG. 9 is a perspective view of a picture frame 910 and hanging mount 950, according to some embodiments of the invention. In some embodiments of the invention and as shown in FIG. 9, a system 900 with a picture frame 910 and a hanging mount 950 is provided. The hanging mount 950 includes two protrusions 960 and mounting holes 955. The picture frame includes a first set of recesses 960*a* and a second pair of recesses 960*b*. The picture frame 910 includes a stand 970 and a storage recess 970*a*. The picture frame 910 includes a first stand slot 980 and a second stand slot 982.

In operation, the hanging mount 950 is attachable to a planar display surface (e.g., a wall, a mantel, a board, or other surfaces). In some embodiments, the hanging mount 950 may be attached to the surface via the mounting holes 955. Any attachment means, such as those described herein, may be used to attach the hanging mount 950 to the surface. If attachment means are used that are not flush (i.e., extend some distance through the rear side, as shown, of the mounting holes), the hanging mount 950 may include a frame guard (e.g., as shown and described further below in reference to FIG. 12 and reference numeral 1210).

The picture frame 910 is designed to mount on the hanging mount 950 via recesses that correspond to the protrusions 960. As illustrated in FIG. 9, the picture frame 910 may mount onto the hanging mount 950 via a first pair of recesses 960*a* that correspond to the shape of the protrusions 960 such that the picture frame is mounted in a first orientation (e.g., an orientation commonly referred to as a "portrait" orientation). To accomplish the mounting as illustrated in FIG. 9, the picture frame 910 may first be placed onto the protrusions 960 at an angle and then may be gently lowered into a resting position in the first orientation. Thus, in some embodiments, the picture frame 910 may be easily and releasably mounted in a first orientation on the hanging mount 950.

The picture frame 910 may also mount onto the hanging mount 950 via a second pair of recesses 960*b* that correspond to the shape of the protrusions 960 such that the picture frame 910 is mounted in a second orientation (e.g., an orientation commonly referred to as a "landscape" orientation). Although the protrusions and recesses are described herein with reference to a hanging mount that includes two protrusions and the corresponding sets of two recesses, more or less protrusions and recesses may be used.

In some embodiments, the hanging mount 950 may mount onto an interim clip (not shown) that contains recesses. As an example, an interim clip may be used that attaches to the rear of a picture frame 910 and contains a pair of recesses 960*a* (or multiple pairs of recesses) to mount the picture frame 910 onto the hanging mount 950. By using a stronger material for the interim clip in comparison to the exterior of the picture frame (e.g., steel instead of plastic), the interim clip may allow the picture frame and its contents to weigh more.

Rather than hanging the picture frame 910 via a hanging mount 950, it may be desirable to stand the picture frame 910 up. Thus, in some embodiments, a stand 970 may be used in combination with one or more corresponding slots (e.g., slots 980 and 982) to display pictures in the picture frame 910 in a standing position and various orientations, rather than a hanging position. The picture frame 910 may include a storage recess 970*a* to store the stand 970 when not in use. The stand 970, storage recess 970*a*, slot 980 and slot 982 are describe further below (e.g., in reference to FIGS. 17A, 17B, 18A, 18B, and 19). As shown in FIG. 9, the stand 970 is stored in the storage recess 970*a*. A close-up view of the storage recess 970*a* (without the stand 970 being stored) is further described and illustrated in reference to FIG. 18A.

In some embodiments, the picture frame 910 may include one or more sets of recesses to help easily and quickly mount the picture frame 910 in various orientations and at various heights and widths. For example, as illustrated in FIG. 10, the picture frame 910 may include a first set of recesses 960*a* (also shown in FIG. 9), a second set of recesses 960*b* (also shown in FIG. 9), a third set of recesses 960*c*, a fourth set of recesses 960*d*, and a fifth set of recesses 960*e*. The picture frame 910 could mount onto any one of these sets of recesses 960*a-e* via a hanging mount (such as hanging mount 950). For example, in the landscape orientation, FIG. 10 illustrates three different ways to mount the picture frame 910.

As already discussed in reference to FIG. 9, the picture frame 910 may mount in a landscape orientation via the second set of recesses 960*b*. However, should it be desirable to mount the picture frame 910 in a landscape orientation but at a different height (e.g., to mount the frame higher in reference to the floor), the picture frame 910 may mount onto a hanging mount via the third set of recesses 960*c*. Similarly, should it be desirable to mount the picture frame 910 in a landscape orientation but at a different width (e.g., to mount the frame to the right in reference to a frame mounted at recesses 960*b*), the picture frame 910 may mount onto a hanging mount via the fourth set of recesses 960*d*.

Similarly, as already discussed, the picture frame 910 may mount in a portrait orientation via the first set of recesses 960*a*. Should it be desirable to mount the picture frame in a portrait orientation but at a different height (e.g., to mount the frame higher in reference to the floor), the picture frame 910 may mount onto a hanging mount via the fifth set of recesses 960*e*.

Although FIG. 10 depicts only five specific sets of recesses and two orientations, this is not intended to be limiting in any way. One of skill in the art would readily understand that more or less of these sets of recesses could be used to mount a picture frame at varying heights, widths, orientations, and/or angles.

Figure 11:
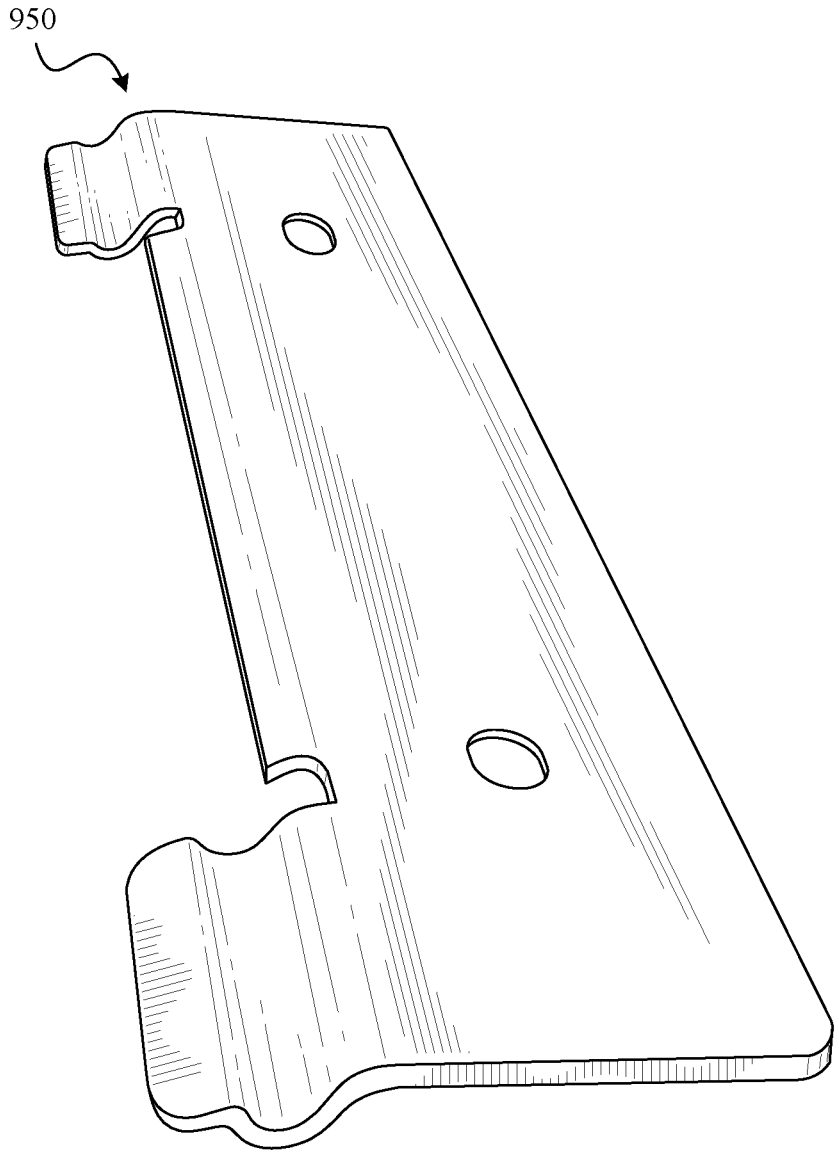
FIG. 11 is a rear perspective view of a hanging mount, according to some embodiments of the invention.
Figure 12:
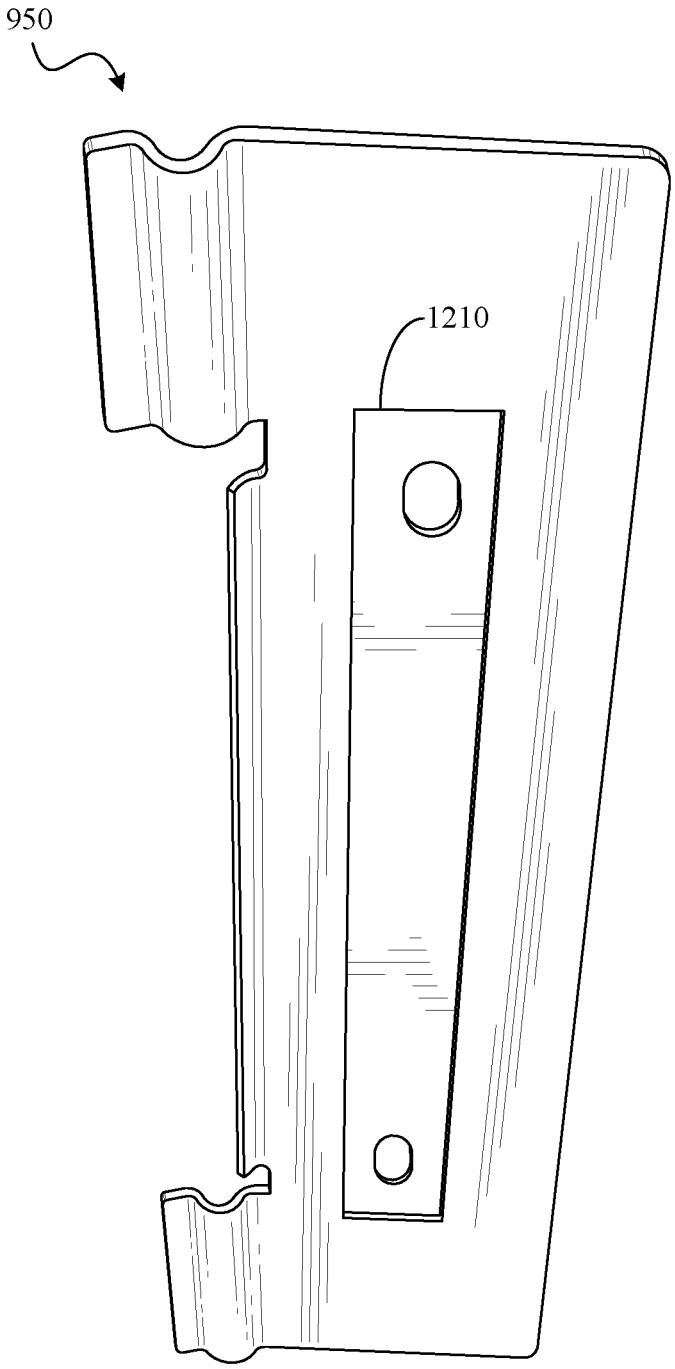
FIG. 12 is a front perspective view of a hanging mount, according to some embodiments of the invention.

FIG. 11 is a rear perspective view of a hanging mount 950, according to some embodiments of the invention. FIG. 12 is a front perspective view of a hanging mount 950, according to some embodiments of the invention. FIG. 12 illustrates a frame guard 1210. The frame guard 1210 may serve various functions. In some embodiments, the frame guard 1210 may protect a picture frame 910 from damage due to the attachment means used to secure the hanging mount 950 to the wall. For example, if two screws with rounded heads are used to attach the hanging mount 950 to a wall, the rounded heads of the screws will extend past the front of the hanging mount 950 and could damage or scratch the rear surface of a picture frame, such as picture frame 910. To prevent this, the frame guard 1210 may be configured to extend out past the anticipated length of the attachment means and provide a smooth contacting surface for the picture frame 910. In a similar vein, the frame guard 1210 may be used to provide a level and smooth contacting surface for a picture frame. For example, the protrusions of a hanging mount (such as protrusions 960) may be designed to mount a picture frame a certain distance away from the wall. In this type of embodiment, the frame guard 1210 may be used to provide a level surface the same distance away from the wall such that the picture frame hangs in a certain manner (e.g., more vertically). Although the frame guard 1210 is illustrated in FIG. 12 as a raised, rectangular surface, various other designs could be used as well. For example, the edges of the rectangle could be moved out such that they comprise four individual raised surfaces that are not touching. As another example, the raised lines could be curved instead of straight lines.

FIG. 13 is a right side view of a hanging mount 950, according to some embodiments of the invention. FIG. 14 is a left side view of a hanging mount 950, according to some embodiments of the invention. FIG. 15 is a top view of a hanging mount 950, according to some embodiments of the invention. FIG. 16 is a bottom view of a hanging mount 950, according to some embodiments of the invention.

Figure 17B:
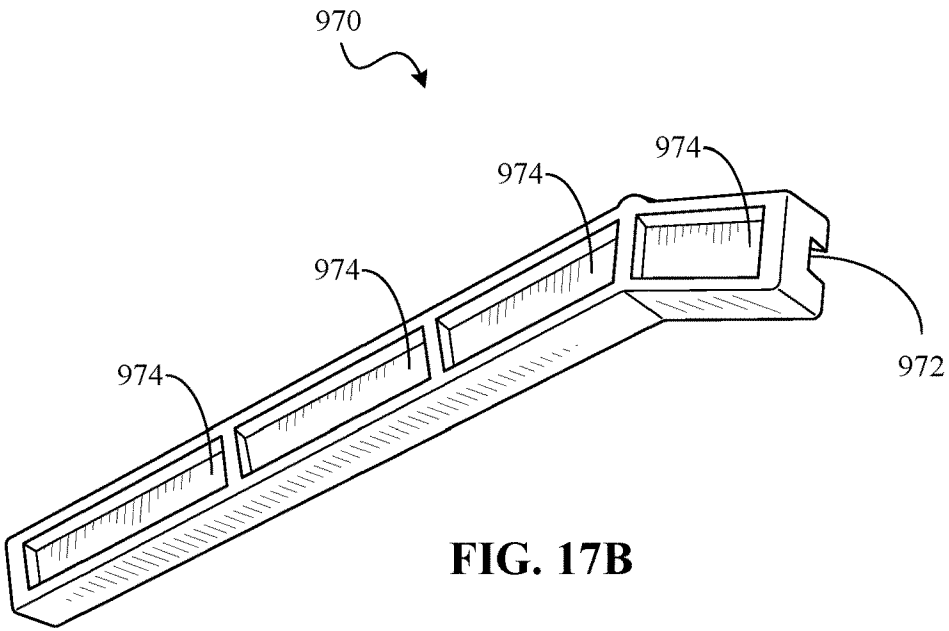
FIG. 17B is a back, bottom perspective view of a stand, according to some embodiments.
Figure 17A:
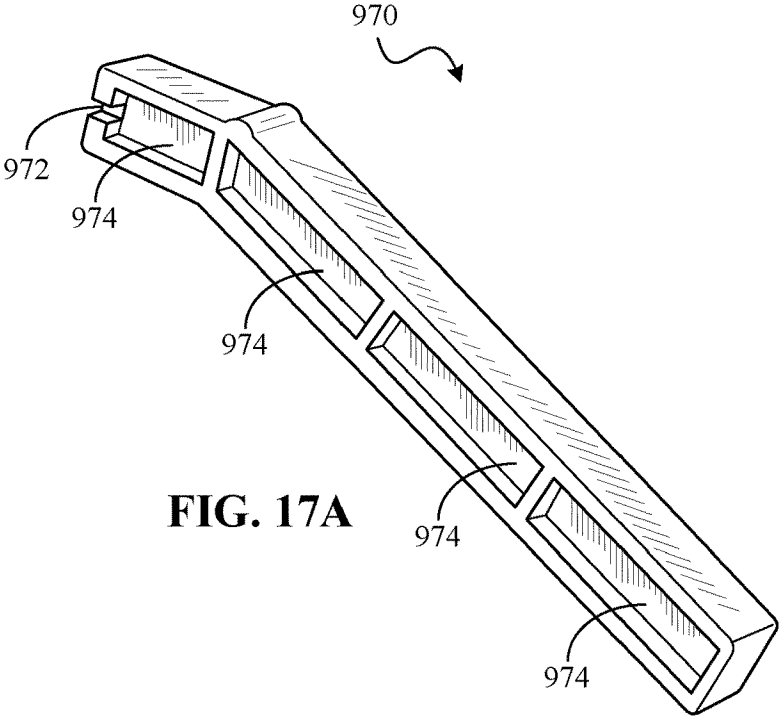
FIG. 17A is a front, top perspective view of a stand, according to some embodiments.

FIG. 17A is a front, top perspective view of a stand 970, according to some embodiments. FIG. 17B is a back, bottom perspective view of a stand 970, according to some embodiments. The stand 970 includes a notch 972 and one or more stand recesses 974. The perspective descriptions are for purposes of illustration only. Here, the side of the stand 970 that includes the notch 972 is described as the "front" side. This is not intended to be limiting as any side can be called the front side.

As described further below in reference to FIGS. 18A, 18B, and 19, the stand 970 may be stored in the storage recess 970*a* when not in use (e.g., when the picture frame 910 is mounted to the wall via a hanging mount 950). In some embodiments, the stand 970 may snap into the picture frame 910 for storage via a protrusion (e.g., protrusion 971 of FIG. 18A) that fits into one or more of the recesses of the stand 970 (e.g., stand recess 974). Similarly, the stand 970 may fit into one or more slots (e.g., slot 980 or 982) to support the frame in an upright position.

Figure 18A:
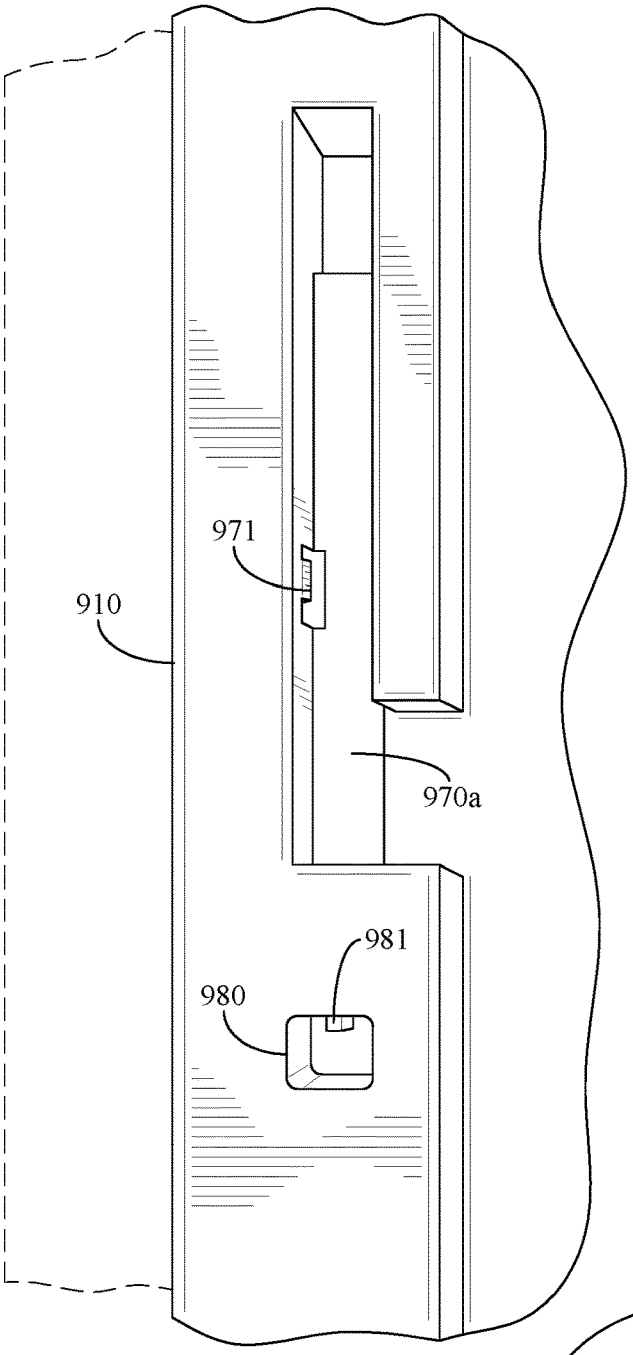
FIG. 18A is a close-up view of a storage recess and a slot of a picture frame, according to some embodiments.

FIG. 18A is a close-up view of a storage recess 970*a* and a slot 980 of a picture frame 910, according to some embodiments. FIG. 18A illustrates a picture frame 910, a storage recess 970*a* with a storage recess protrusion 971, and a slot 980 with a slot protrusion 981. In some embodiments, the stand 970 may fit into the slot 980 and provide support to the picture frame 910 such that pictures are displayed in a landscape orientation. In some embodiments, the stand 970 may include a notch 972 that corresponds to a slot protrusion 981 such that the stand 970 may only be inserted into the notch 972 in a particular orientation. Although only one notch 972 and one slot protrusion 981 are shown, more than one of each may be used. Similarly, other designs or patterns may be used to ensure the stand 970 may only be fit into a slot in a particular orientation.

Figure 18B:
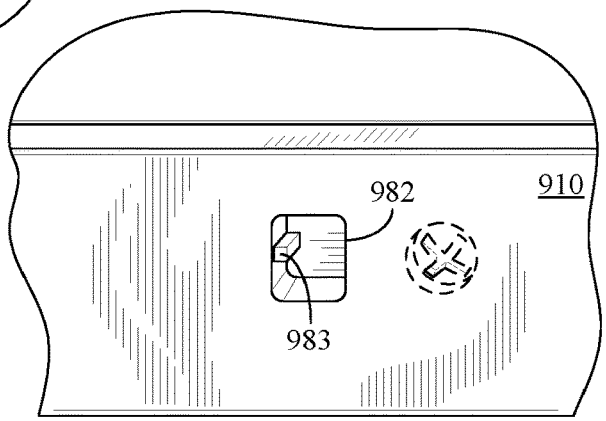
FIG. 18B is a close-up view of a slot of a picture frame, according to some embodiments.

FIG. 18B is a close-up view of a slot 982 of a picture frame 910, according to some embodiments. FIG. 18B illustrates a picture frame 910 and a slot 982 with a slot protrusion 983. In some embodiments, the stand 970 may fit into the slot 982 and provide support to the picture frame 910 such that pictures are displayed in a portrait orientation. As previously described, the stand 970 and the slot 982 may include corresponding structures that enable the stand 970 to fit into the slot 982 only in a particular orientation.

Figure 19:
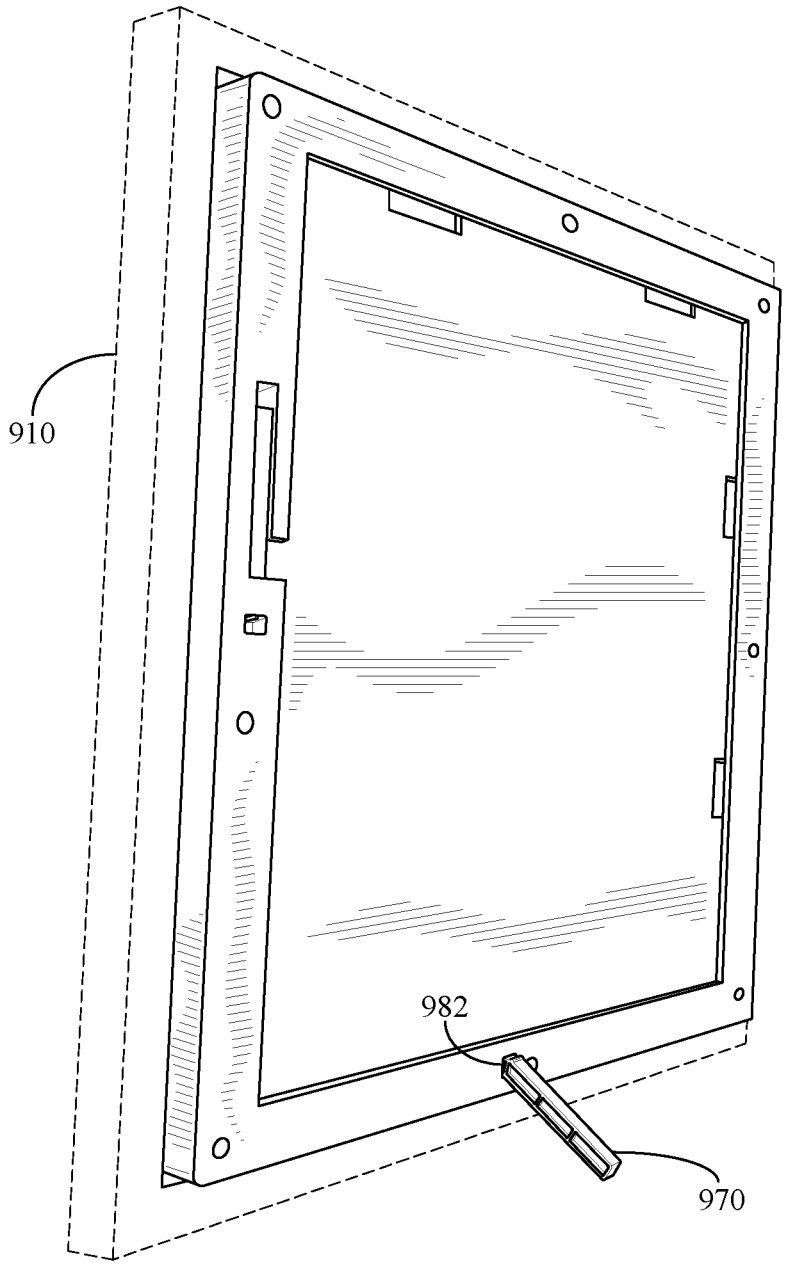
FIG. 19 is a perspective view of a picture frame, according to some embodiments.

FIG. 19 is a perspective view of a picture frame 910, according to some embodiments. As illustrated in FIG. 19, the stand 970 fits into a slot 982 such that the picture frame 910 is supported in a standing position by the stand 970.

Figure 21:
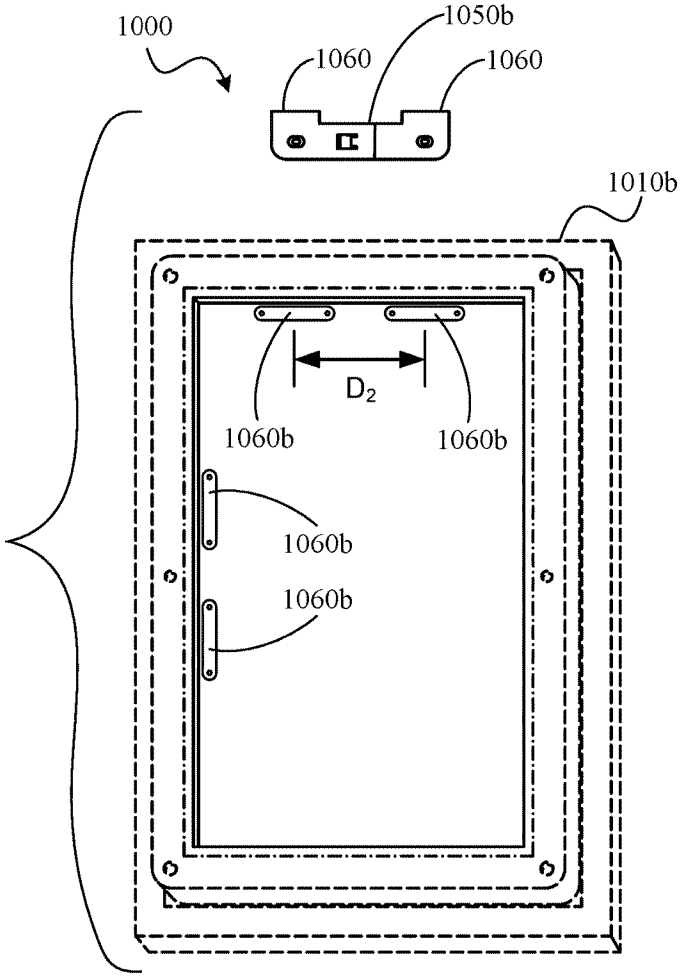
FIG. 21 is a rear view of a picture frame and associated hanging mount, according to some embodiments of the invention.
Figure 20:
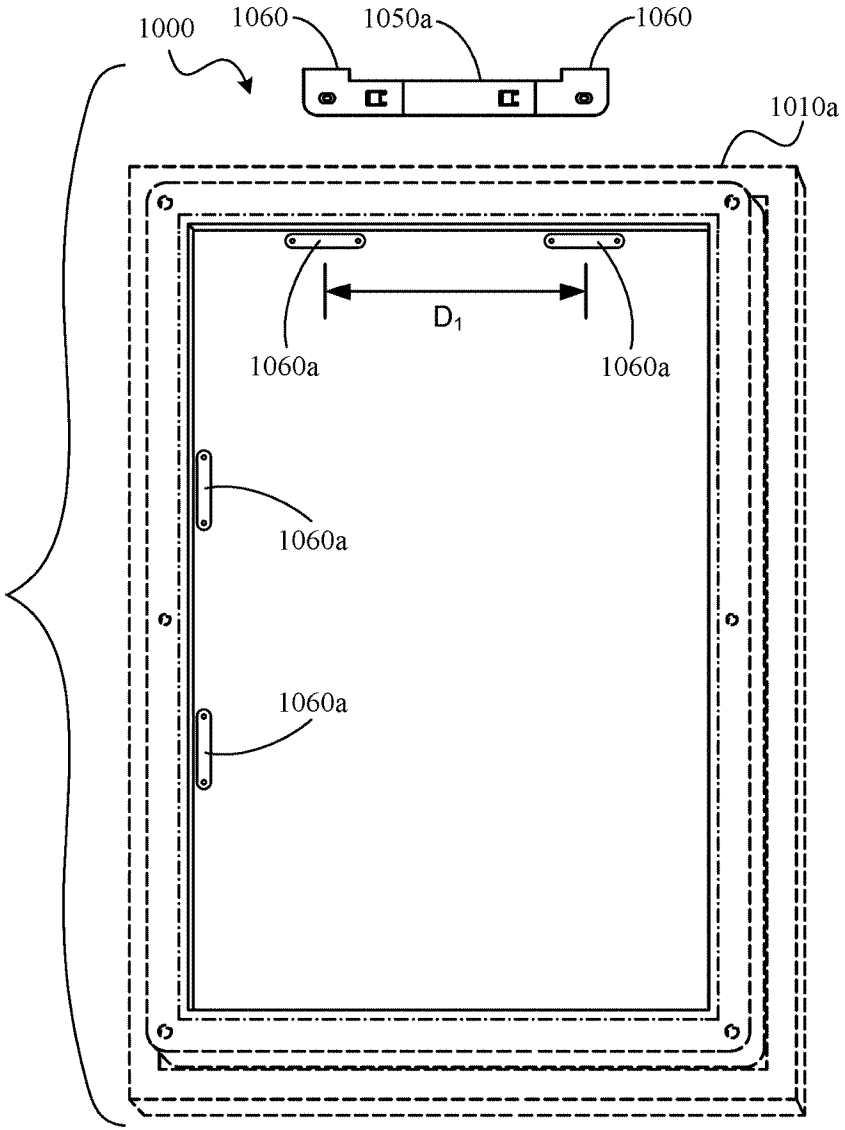
FIG. 20 is a rear view of a picture frame and associated hanging mount, according to some embodiments of the invention.

Another embodiment of a mounting system 1000 in accordance with the present disclosure is shown in FIGS. 20 and 21. The system 1000 includes an adjustable hanging mount, shown in a first configuration 1050*a* in FIG. 20 and a second configuration 1050*b* in FIG. 21, for use with multiple picture frames 1010*a* and 1010*b*. The hanging mount 1050*a*, 1050*b* includes two protrusions 1060 for engagement with hangers 1060*a*, 1060*b* coupled to the picture frames 1010*a*, 1010*b* to support the picture frames 1010*a*, 1010*b*, such as for hanging on a wall.

In the illustrative embodiment, the picture frame 1010*a* is formed to include hangers 1060*a* spaced apart at a distance $D_1$ and the hanging mount in the first configuration 1050*a* is arranged so that the protrusions 1060 are spaced apart at a similar distance to the hangers 1060*a* as shown in FIG. 20. The picture frame 1010*b* is formed to include hangers 1060*b* spaced apart at a distance $D_2$, smaller than the distance $D_1$, and the hanging mount in the second configuration 1050*b* is arranged so that the protrusions 1060 are spaced apart at a similar distance to the hangers 1060*b* as shown in FIG. 21.

As detailed further below, the adjustable hanging mount 1050*a*, 1050*b* can be arranged in several different configurations for engaging with hangers spaced apart at various distances wider and/or narrower than the distances $D_1$, $D_2$.

Figure 22:
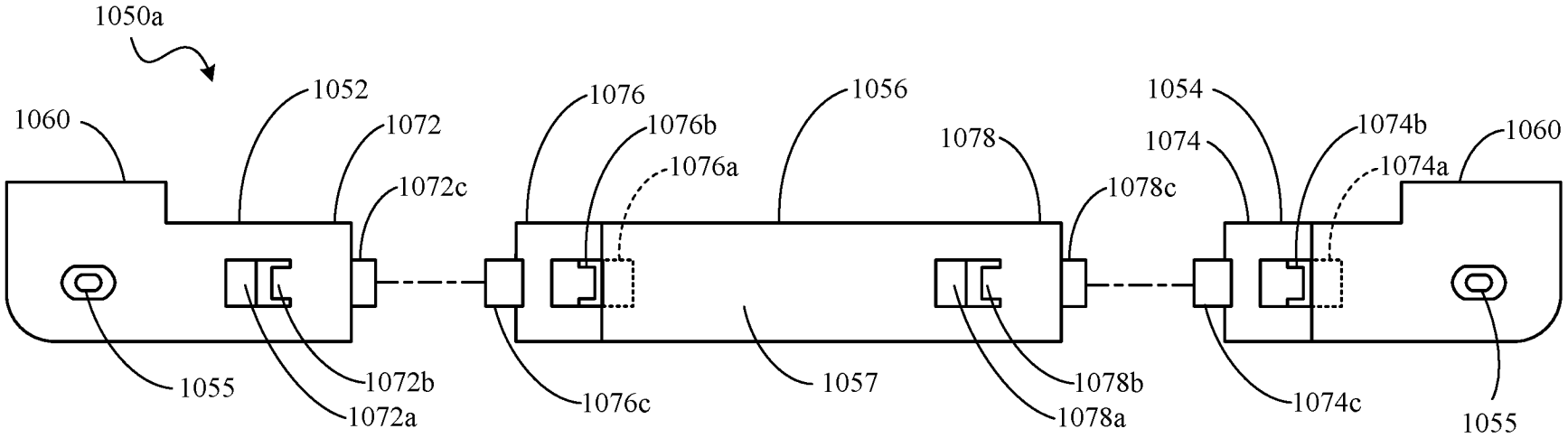
FIG. 22 is an front exploded view of the hanging mount shown in FIG. 20.
Figure 23:
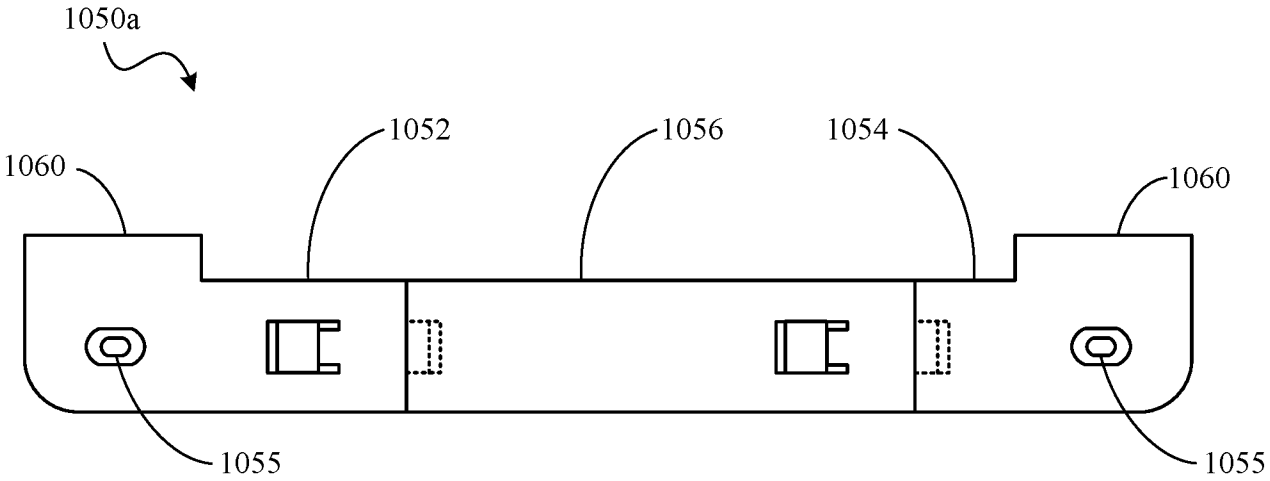
FIG. 23 is a front view of the hanging mount shown in FIG. 20.

The adjustable hanging mount 1050*a* includes a first end 1052, a second end 1054, and a spacer member 1056 as shown in FIGS. 22 and 23. The first end 1052 includes a first one of the protrusions 1060 thereon and a first coupler 1072 extending from the first protrusion 1060. The second end 1054 includes a second one of the protrusions 1060 thereon and a second coupler 1074 extending from the second protrusion 1060. The spacer member includes a third coupler 1076 and a fourth coupler 1078 spaced apart from one another by a central body 1057. The first coupler 1072 of the first end 1052 engages with the third coupler 1076 of the spacer member 1056 and the second coupler 1074 of the second end 1054 engages with the fourth coupler 1078 of the spacer member 1056 to form the hanging mount 1050*a*. Any type of coupler can be used for securing the first and second ends 1052, 1054 to the spacer member 1056. As further detailed below, more or less spacer members 1056 can be connected together to change the spacing between the first and second ends 1052, 1054.

In the illustrative embodiment, the first coupler 1072 of the first end 1052 includes a pocket 1072*a* formed into the first end 1052, a flexible lock tab 1072*b* extending toward the pocket 1072*a*, and a grip tab 1072*c* extending from the first end 1052 away from the pocket 1072*a* and the first protrusion 1060 as shown in FIG. 22. The second coupler 1074 of the second end 1054 includes a pocket 1074*a* formed into the second end 1054, a flexible lock tab 1074*b* extending toward the pocket 1074*a*, and a grip tab 1074*c* extending from the second end 1054 away from the pocket 1074*a* and the second protrusion 1060. The third coupler 1076 of the spacer member includes a pocket 1076*a* formed into the spacer member 1056, a flexible lock tab 1076*b* extending toward the pocket 1076*a*, and a grip tab 1076*c* extending outward from the spacer member 1056 away from the pocket 1076*a*. The fourth coupler 1078 of the spacer member 1056 includes a pocket 1078*a* formed into the spacer member 1056, a flexible lock tab 1078*b* extending toward the pocket 1078*a*, and a grip tab 1078*c* extending outward from the spacer member 1056 away from the pocket 1078*a*.

Figure 24:
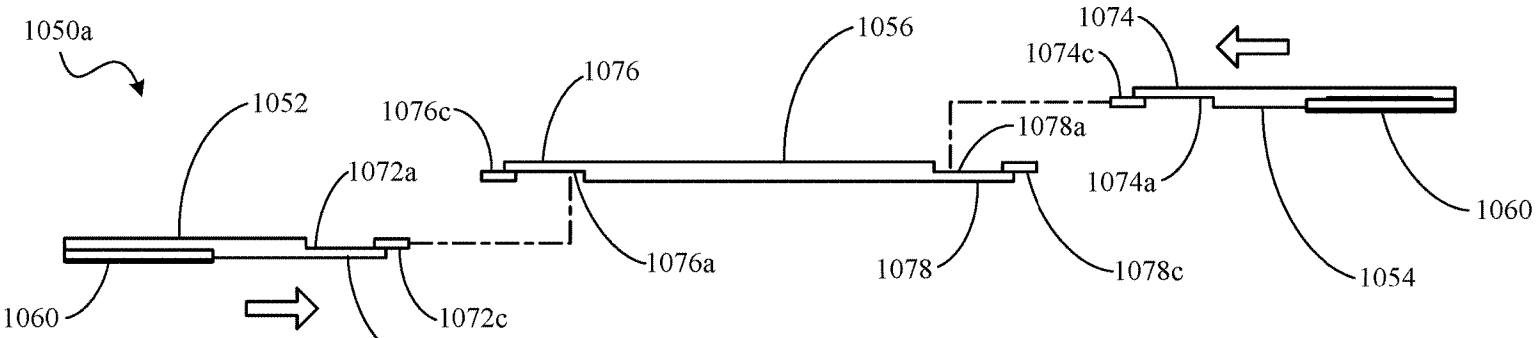
FIGS. 24-27 are a series of top views illustrating assembly of the hanging mount shown in FIG. 20.
Figure 25:
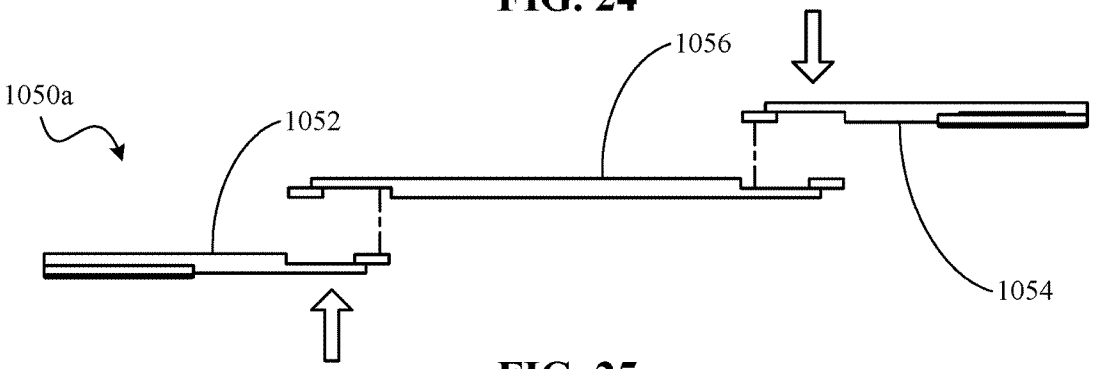
Figure 26:
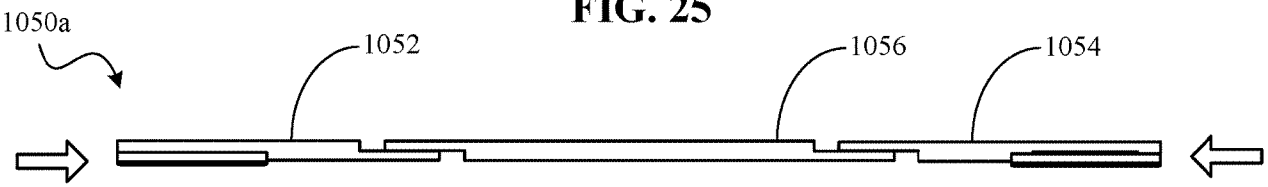
Figure 27:
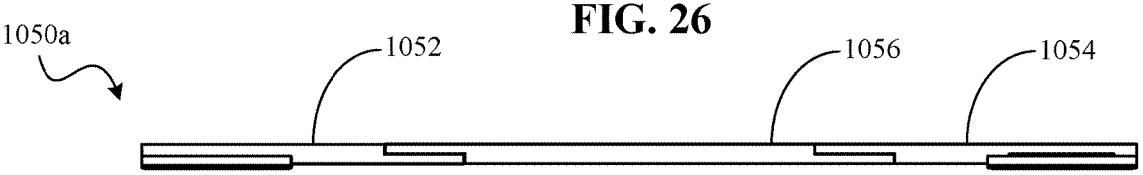

To assemble the hanging mount 1050*a*, the grip tabs 1072*c*, 1074*c*, 1076*c*, 1078*c* are inserted into the corresponding pockets 1072*a*, 1074*a*, 1076*a*, 1078*a* as shown in FIGS. 24-26. The flexible lock tabs 1072*b*, 1074*b*, 1076*b*, 1078*b* are biased by the grip tabs 1072*c*, 1074*c*, 1076*c*, 1078*c* as the grip tabs 1072*c*, 1074*c*, 1076*c*, 1078*c* are inserted into the pockets 1072*a*, 1074*a*, 1076*a*, 1078*a*. The first and second ends 1052, 1054 are then pushed toward the spacer member 1056 as shown in FIGS. 26 and 27. The flexible lock tabs 1072*b*, 1074*b*, 1076*b*, 1078*b* spring back to engage with the respective grip tabs 1072*c*, 1074*c*, 1076*c*, 1078*c* to block separation of the first and second ends 1052, 1054 from the spacer member 1056. The lock tabs 1072*b*, 1074*b*, 1076*b*, 1078*b* can be biased by a user to allow separation of the first and second ends 1052, 1054 from the spacer member 1056. Additional spacers 1056 can be coupled together in a chain between the first and second ends 1052, 1054 to increase the spacing between the first and second ends 1052, 1054.

Figure 28:
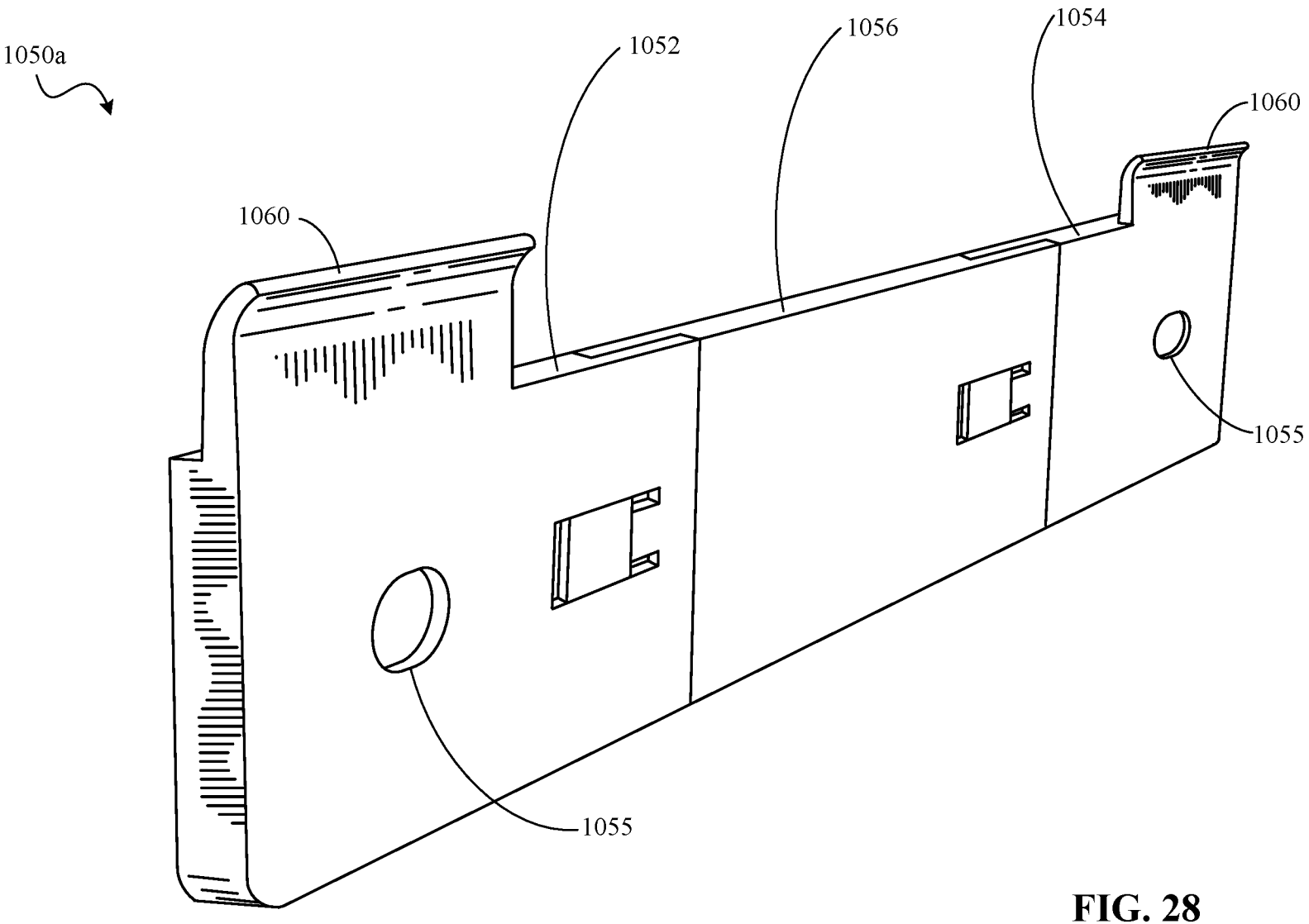
FIG. 28 is a perspective view of the hanging mount shown in FIG. 20.

The assembled hanging mount 1050*a* is shown in FIG. 28. The protrusions 1060 extend toward a front side of the hanging mount 1050*a* (visible in FIG. 28) such that distal tips of the protrusions 1060 are spaced apart from the surface that hanging mount 1050*a* is attached to allow engagement with the hangers 1060*a* on the picture frame 1010*a*. Mounting holes 1055 formed through the first and second 1052, 1054 allow a fastener to extend through the hanging mount 1050*a* for securing the hanging mount 1050*a* to a surface, such as a wall. A rear side of the hanging mount 1050*a* (opposite the front side) is substantially planar to allow an adhesive to be used in securing the hanging mount 1050*a* to a surface in addition or alternative to fasteners.

Figure 29:
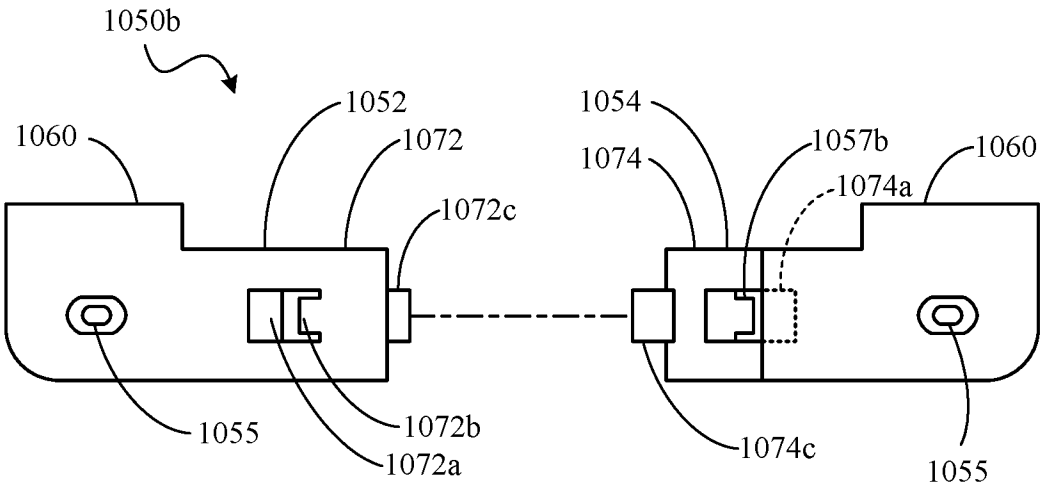
FIG. 29 is an front exploded view of the hanging mount shown in FIG. 21.
Figure 30:
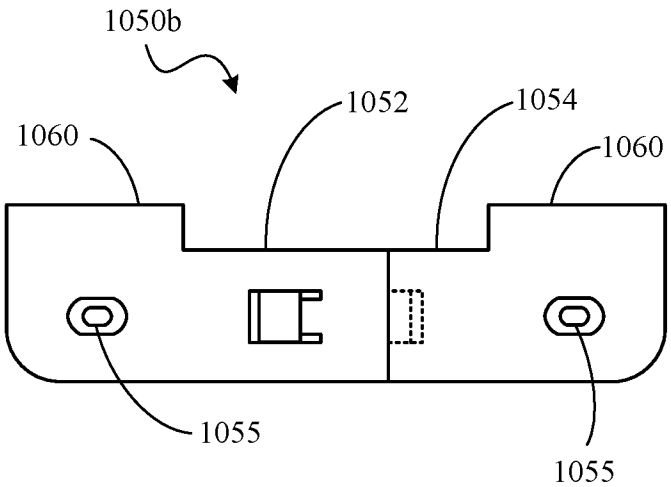
FIG. 30 is a front view of the hanging mount shown in FIG. 29.

In the second configuration of the hanging mount 1050*b*, the first end 1052 connects directly to the second end 1054 as shown in FIGS. 29 and 30. In the illustrative embodiment, the first coupler 1072 of the first end 1052 engages with the second coupler 1074 of the second end 1054. The grip tabs 1072*c*, 1074*c* are inserted into the corresponding pockets 1072*a*, 1074*a* until the lock tabs 1072*b*, 1074*b* spring back to block separation of the first end 1052 from the second end 1054.

Figure 32:
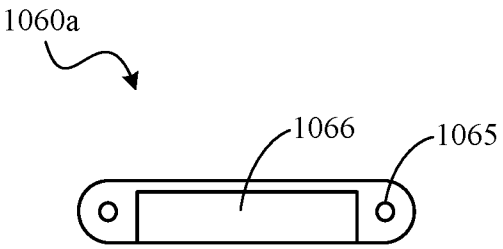
FIG. 32 is a front view of a hanger, according to some embodiments of the invention.
Figure 31:
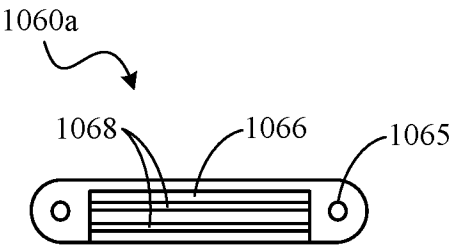
FIG. 31 is a front view of a hanger, according to some embodiments of the invention.
Figure 33:
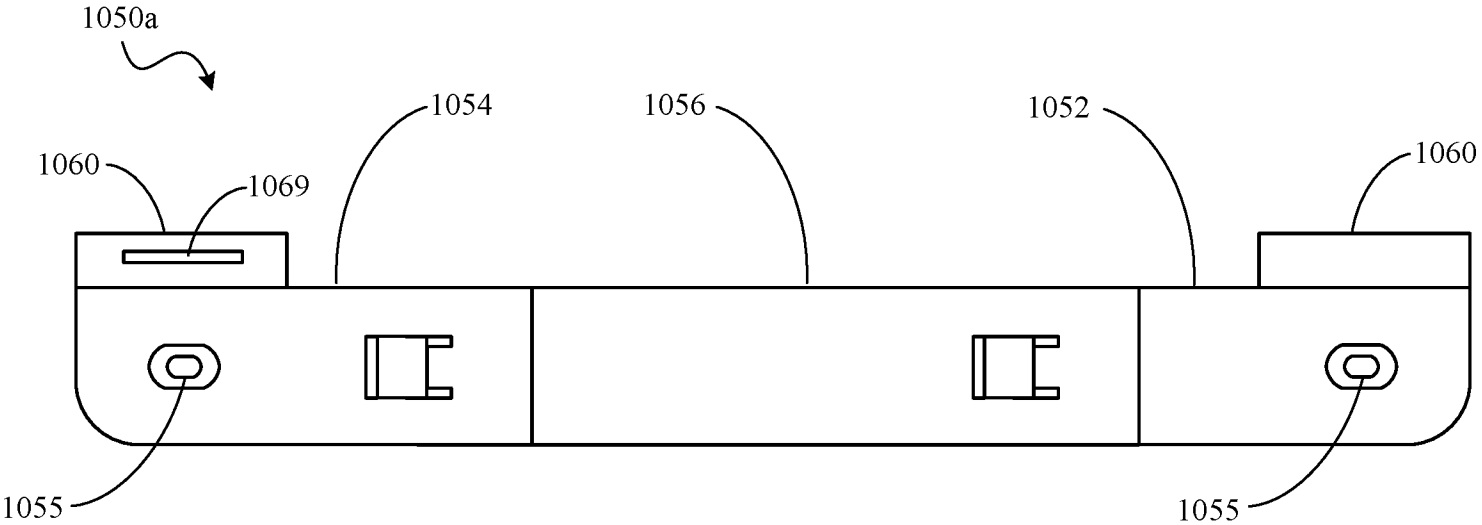
FIG. 33 is a rear view of a hanging mount, according to some embodiments of the invention.

An illustrative embodiment of a hanger 1060*a* in accordance with the present disclosure for use with the hanging mount in the first and second configurations 1050*a*, 1050*b* is shown in FIG. 31. The hanger 1060*a* includes mounting holes 1055 for securing the hanger 1060*a* to a picture frame and a recess 1066 formed into the hanger 1060*a* for receiving the protrusions 1060. In the illustrative embodiment, a pair of spaced apart ribs 1068 are formed across the recess 1066. In some embodiments a single rib 1068 is used. In some embodiments, no ribs are used as suggested in FIG. 32. In some embodiments, a rib 1069 is formed at least partially across one or both of the protrusions 1060 as shown in FIG. 33. The rib 1069 of the protrusion 1060 engages with the ribs 1068 of the hanger 1068 for securing the protrusion 1060 within the recess 1066.

In some embodiments, the hanger 1060*a* having the ribs 1068 is mounted on the picture frame 1010*a* toward a side of the picture frame 1010*a* having attachment means (such as means 56 described above), and the hanger 1060*a* without the ribs 1068 is mounted toward a side of the picture frame 1010*a* having a hinge for a front frame member on a front of the picture frame 1010*a* (similar to hinge 80 and front frame member 50 described above). When picture frame 1010*a* is mounted on hanging mount 1050*a*, the protrusions 1060 are trapped between the hangers 1060*a* and a rear of the picture frame 1010*a*. In some embodiments, engagement between the rib 1069 on the protrusion and the ribs 1068 of the hanger 1060*a* blocks tilting of the picture frame 1010*a* when the front frame member is moved to an open position. In some embodiments, the picture frame 1010*a* is dismounted from the hanging mount 1050*a* by rotating the picture frame 1010*a* relative to the hanging mount 1050*a* such that the rib 1069 disengages from the ribs 1068 to allow removal of the protrusion 1060 from the recess 1066. The hangers 1060*b* of picture frame 1010*b* can be similarly arranged for engagement with the hanging mount in the second configuration 1050*b* as described above for hangers 1060*a* and picture frame 1010*a*. In some embodiments, all hangers 1060*a*, 1060*b* include the ribs 1068.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A hanging mount comprising:

a first end having a first protrusion and a first coupler extending from the first protrusion;

a second end having a second protrusion and a second coupler extending from the second protrusion; and at least one spacer member, the at least one spacer member having a third coupler and a fourth coupler positioned at opposing ends of the at least one spacer member;

wherein the first coupler engages with the third coupler and the second coupler engages with the fourth coupler in a first configuration of the hanging mount for engaging the hanging mount with a first frame having hangers positioned a first distance apart corresponding to the first and second protrusions, and the first coupler and the second coupler engage with one another in a second configuration of the hanging mount for engaging the hanging mount with a second frame having hangers positioned a second distance apart corresponding to the first and second protrusions with the second distance being shorter than the first distance, wherein each of the first, second, third, and fourth couplers includes a pocket, a lock tab extending toward the pocket, and a grip tab extending away from the pocket, wherein the grip tab of one of the first, second, third, or fourth couplers is configured to be received in the pocket of another one of the first, second, third, or fourth couplers, and wherein the lock tab is configured to engage with the grip tab received in the pocket to block removal of the grip tab from the pocket at the selection of a user.

2. The hanging mount of claim 1, further comprising another spacer member coupled to one of the first or second ends and the other spacer member to arrange the protrusions at a third distance apart from one another wider than the first distance.

3. The hanging mount of claim 1, wherein at least one of the hangers is formed to define a recess and a rib extending across the recess, wherein a rib extends at least partially across at least one of the protrusions, and wherein the rib of the hanger is configured to engage with the rib of the protrusion to secure the protrusion in the recess.

4. The hanging mount of claim 1, wherein the hanging mount is secured to a surface with at least one of a fastener and an adhesive.

5. A mounting system comprising:

a picture frame having a plurality of hangers coupled thereto and spaced apart by a first distance or a second shorter distance; and a hanging mount configured to be secured to a surface, the hanging mount comprising:

a first end having a first protrusion and a first coupler extending from the first protrusion;

a second end having a second protrusion and a second coupler extending from the second protrusion; and at least one spacer member, the at least one spacer member having a third coupler and a fourth coupler positioned at opposing ends of the at least one spacer member;

wherein the first coupler engages with the third coupler and the second coupler engages with the fourth coupler in a first configuration of the hanging mount for engaging the protrusions of the hanging mount with the hangers of the picture frame spaced at the first distance, and the first coupler and the second coupler engage with one another in a second configuration of the hanging mount for engaging the protrusions of the hanging mount with the hangers of the picture frame spaced at the second distance.

6. The mounting system of claim 5, wherein each of the first, second, third, and fourth couplers includes a pocket, a lock tab extending toward the pocket, and a grip tab extending away from the pocket, wherein the grip tab is configured to be received in the pocket, and wherein the lock tab is configured to engage with the grip tab to block removal of the grip tab from the pocket at the selection of a user.

7. The mounting system of claim 5, further comprising another spacer member coupled to one of the first or second ends and the other spacer member to arrange the protrusions at a third distance apart from one another wider than the first distance.

8. The mounting system of claim 5, wherein at least one of the hangers is formed to define a recess and a rib extending across the recess, wherein a rib extends at least partially across at least one of the protrusions, and wherein the rib of the hanger is configured to engage with the rib of the protrusion to secure the protrusion in the recess.

9. The mounting system of claim 8, wherein the picture frame is dismounted from the hanging mount by rotating the picture frame relative to the hanging mount to disengage the rib of the protrusion from the rib of the recess and allow removal of the protrusion from the recess.

10. The mounting system of claim 5, wherein the hanging mount is secured to the surface with at least one of a fastener and an adhesive.

11. A mounting system comprising:

a picture frame having a plurality of hangers coupled thereto; and a hanging mount configured to be secured to a surface, the hanging mount comprising:

a first end having a first protrusion and a first coupler extending from the first protrusion; and a second end having a second protrusion and a second coupler extending from the second protrusion;

wherein the first coupler engages with the second coupler to hold the first and second ends together at the selection of a user, and the protrusions of the hanging mount engage with the hangers of the picture frame to support the picture frame on the surface, wherein each of the first and second couplers includes a pocket, a lock tab extending toward the pocket, and a grip tab extending away from the pocket, wherein the grip tab of one of the first or second couplers is configured to be received in the pocket of the other of the first or second couplers, and wherein the lock tab is configured to engage with the grip tab received in the pocket to block removal of the grip tab from the pocket at the selection of a user.

12. The mounting system of claim 11, wherein at least one of the hangers is formed to define a recess and a rib extending across the recess, wherein a rib extends at least partially across at least one of the protrusions, and wherein the rib of the hanger is configured to engage with the rib of the protrusion to secure the protrusion in the recess.

13. The mounting system of claim 12, wherein the picture frame is dismounted from the hanging mount by rotating the picture frame relative to the hanging mount to disengage the rib of the protrusion from the rib of the recess and allow removal of the protrusion from the recess.

14. The mounting system of claim 11, wherein the hanging mount is secured to the surface with at least one of a fastener and an adhesive.

* * * * *